US010476177B2

(12) United States Patent
Okuda

(10) Patent No.: US 10,476,177 B2
(45) Date of Patent: Nov. 12, 2019

(54) ELECTRIC WIRE WITH TERMINAL AND TERMINAL CRIMPING APPARATUS

(71) Applicant: Yazaki Corporation, Tokyo (JP)

(72) Inventor: Yuta Okuda, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/000,813

(22) Filed: Jun. 5, 2018

(65) Prior Publication Data

US 2018/0358713 A1 Dec. 13, 2018

(30) Foreign Application Priority Data

Jun. 9, 2017 (JP) ..... 2017-114131

(51) Int. Cl.
*H01R 4/10* (2006.01)
*H01R 4/18* (2006.01)
*H01R 4/70* (2006.01)

(52) U.S. Cl.
CPC ..... *H01R 4/184* (2013.01); *H01R 4/188* (2013.01); *H01R 4/70* (2013.01)

(58) Field of Classification Search
CPC ..... H01R 4/184; H01R 43/048; H01R 4/185; H01R 4/70; H01R 4/188
USPC ..... 439/877, 878
See application file for complete search history.

(56) References Cited

U.S. PATENT DOCUMENTS 5,636,438 A 6/1997 Takagishi
2008/0168653 A1* 7/2008 Chikyu ..... H01R 43/0486 29/863
2009/0036004 A1* 2/2009 Bowen ..... H01R 13/115 439/849
2010/0192366 A1* 8/2010 Ito ..... H01R 43/058 29/753
2010/0248559 A1* 9/2010 Fukase ..... H01R 4/185 439/878
2013/0040509 A1* 2/2013 Mitose ..... H01R 4/185 439/877
2013/0095708 A1 4/2013 Mitose et al.
(Continued)

FOREIGN PATENT DOCUMENTS

JP 5-57760 U 7/1993
JP 8-37079 A 2/1996
(Continued)

OTHER PUBLICATIONS

Japanese Office Action for the related Japanese Patent Application No. 2017-114131 dated Apr. 23, 2019.

*Primary Examiner* — Abdullah A Riyami
*Assistant Examiner* — Nelson R. Burgos-Guntin
(74) *Attorney, Agent, or Firm* — Kenealy Vaidya LLP

(57) ABSTRACT

An electric wire with a terminal includes: an electric wire; and a crimp terminal including a terminal connection part on a front side and an electric wire connection part on a rear side, the terminal connection part configured to be electrically connected to a counterpart terminal, the electric wire connection part being wound around and crimped onto the electric wire, in which a bent part is formed on a bottom face of the electric wire connection part, the bent part being bent toward a side for causing a rear end of the bottom face to be closer to a center axis of the electric wire connection part.

9 Claims, 24 Drawing Sheets

(56) References Cited

U.S. PATENT DOCUMENTS

2013/0213710 A1* 8/2013 Ohnuma ..... H01R 4/185 174/84 C
2013/0240265 A1* 9/2013 Itou ..... H01R 4/70 174/84 C
2013/0273787 A1* 10/2013 Mitose ..... H01R 4/185 439/878
2014/0224535 A1* 8/2014 Otsuka ..... H01R 4/185 174/74 R
2014/0235118 A1* 8/2014 Bleicher ..... H01R 13/113 439/878
2014/0335745 A1* 11/2014 Kawamura ..... H01R 4/10 439/878
2015/0155673 A1* 6/2015 Kawamura ..... H01R 43/02 29/860
2015/0340772 A1* 11/2015 Kawamura ..... H01R 4/187 439/877
2015/0364835 A1* 12/2015 Tonoike ..... H01R 43/0488 439/879
2015/0364837 A1* 12/2015 Yagi ..... B23K 26/24 439/879
2016/0261054 A1* 9/2016 Sato ..... H01R 4/70
2016/0285187 A1* 9/2016 Oba ..... H01R 4/023
2016/0359245 A1* 12/2016 Aoki ..... H01R 4/185
2016/0372841 A1* 12/2016 Sato ..... H01R 4/185
2017/0005417 A1* 1/2017 Aoki ..... H01R 4/62
2017/0047677 A1* 2/2017 Bhagyanathan Sathianathan ..... H01R 13/113
2017/0179614 A1* 6/2017 Kitagawa ..... H01R 4/185
2017/0179615 A1* 6/2017 Shinohara ..... H01R 4/185
2017/0179616 A1* 6/2017 Anma ..... H01R 4/185
2017/0179617 A1* 6/2017 Yoshida ..... H01R 4/185
2017/0179618 A1* 6/2017 Yoshida ..... H01R 4/185
2017/0179619 A1* 6/2017 Nakata ..... H01R 4/185
2018/0034185 A1* 2/2018 Nagasaka ..... H01R 13/428
2018/0358713 A1* 12/2018 Okuda ..... H01R 4/184
2018/0375276 A1* 12/2018 Onuma ..... H01R 43/005

FOREIGN PATENT DOCUMENTS

JP 2013-89554 A 5/2013
WO 2011/122622 A1 10/2011

* cited by examiner

ELECTRIC WIRE WITH TERMINAL AND TERMINAL CRIMPING APPARATUS

CROSS-REFERENCE TO RELATED APPLICATION(S)

The present application claims priority to and incorporates by reference the entire contents of Japanese Patent Application No. 2017-114131 filed in Japan on Jun. 9, 2017.

BACKGROUND OF THE INVENTION

1. Field of the Invention

The present invention relates to an electric wire with a terminal and a terminal crimping apparatus.

2. Description of the Related Art

In the related art, there is known an electric wire with a terminal including an electric wire and a crimp terminal crimped onto the electric wire. International Publication WO 2011/122622 discloses a technique of a crimp terminal crimped with a barrel piece so that a crimping part continuously and integrally surrounds from a side closer to a distal end than an electric wire exposed part to a side closer to a rear end than a coated distal end of an insulating coating.

In crimping the crimp terminal onto the electric wire, it is preferable to be able to prevent undesired deformation of the crimp terminal from being caused. For example, if a portion projecting from another portion is formed in the crimp terminal after crimping, the projecting part may interfere with a terminal accommodating part in an assembling process.

SUMMARY OF THE INVENTION

The present invention provides an electric wire with a terminal and a terminal crimping apparatus that can prevent a crimp terminal from interfering with a terminal accommodating part.

A electric wire with a terminal according to one aspect of the present invention includes an electric wire; and a crimp terminal including a terminal connection part on a front side and an electric wire connection part on a rear side, the terminal connection part being configured to be electrically connected to a counterpart terminal, the electric wire connection part being wound around and crimped onto the electric wire, wherein a bent part is formed on a bottom face of the electric wire connection part, the bent part being bent toward a side for causing a rear end of the bottom face to be closer to a center axis of the electric wire connection part.

A terminal crimping apparatus according to another aspect of the present invention includes a terminal supply device configured to supply a terminal chain body including a plurality of crimp terminals arranged in parallel, a coupling piece extending along an arrangement direction of the crimp terminals, and a connecting part connecting one end of the crimp terminal with the coupling piece; a first die including a supporting surface configured to support the crimp terminal supplied by the terminal supply device, and a first edge part arranged at one end of the supporting surface; a second die arranged to be opposed to the supporting surface, and configured to sandwich the crimp terminal and the electric wire between the second die and the supporting surface to crimp the crimp terminal onto the electric wire while moving relatively to the supporting surface; and a terminal cut body arranged to be adjacent to the first die and including a second edge part corresponding to the first edge part, wherein the terminal cut body moves relatively to the first die in the same direction as a moving direction of the second die, and cuts off a boundary between the connecting part and the crimp terminal with the second edge part in cooperation with the first edge part, and an end of the supporting surface on the first edge part is inclined toward the second die as coming closer to the first edge part.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes an electric wire with a terminal and a terminal crimping apparatus according to an embodiment of the present invention in detail with reference to the drawings. The present invention is not limited to the embodiment. Components in the following embodiment include components that can be easily conceived by those skilled in the art or that are substantially the same.

Embodiment

Figure 1:
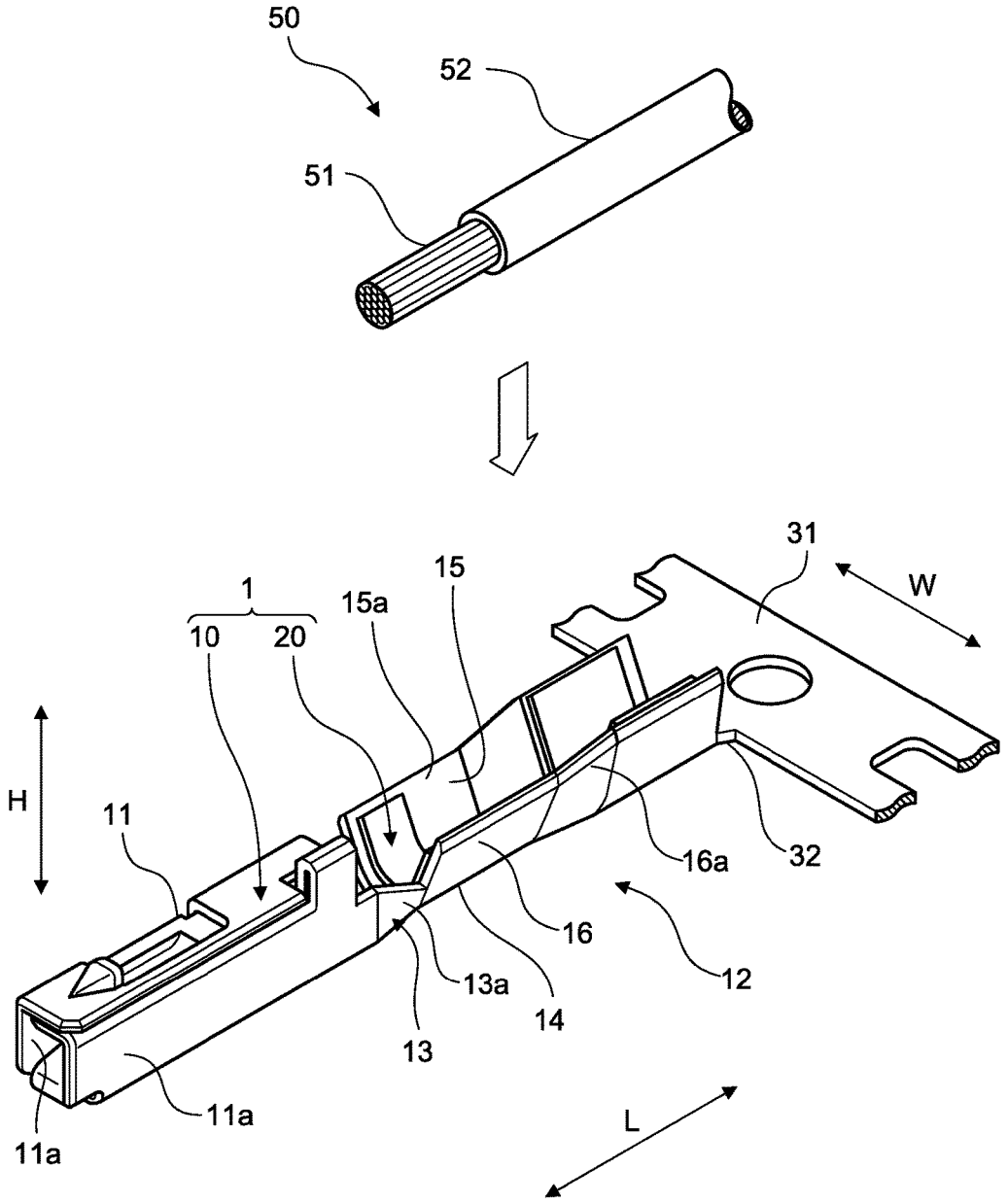
FIG. 1 is a perspective view illustrating a state of a crimp terminal according to an embodiment before crimping.
Figure 2:
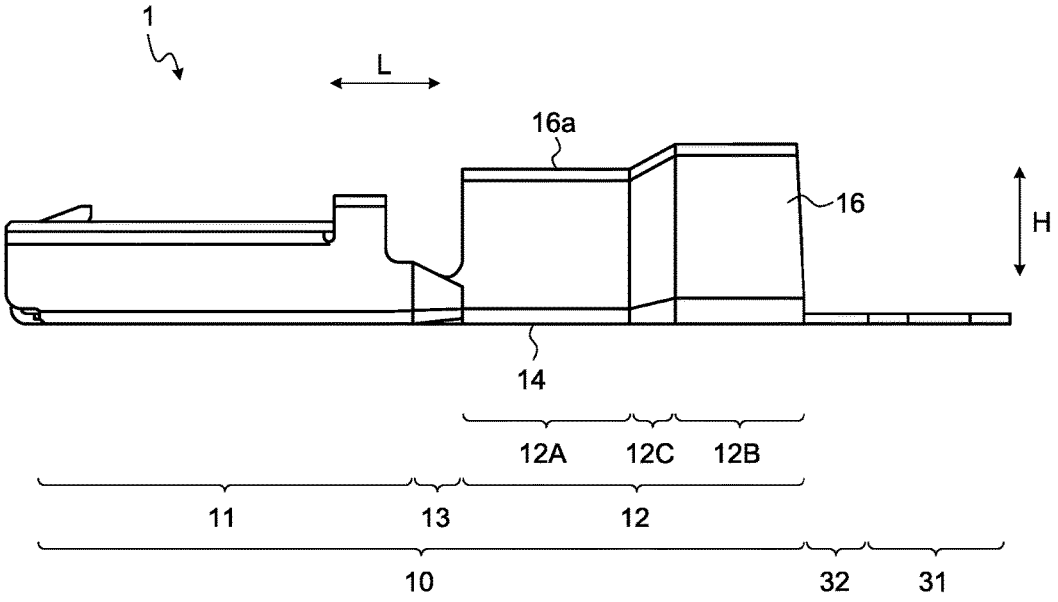
FIG. 2 is a side view illustrating a state of the crimp terminal according to the embodiment before crimping.
Figure 3:
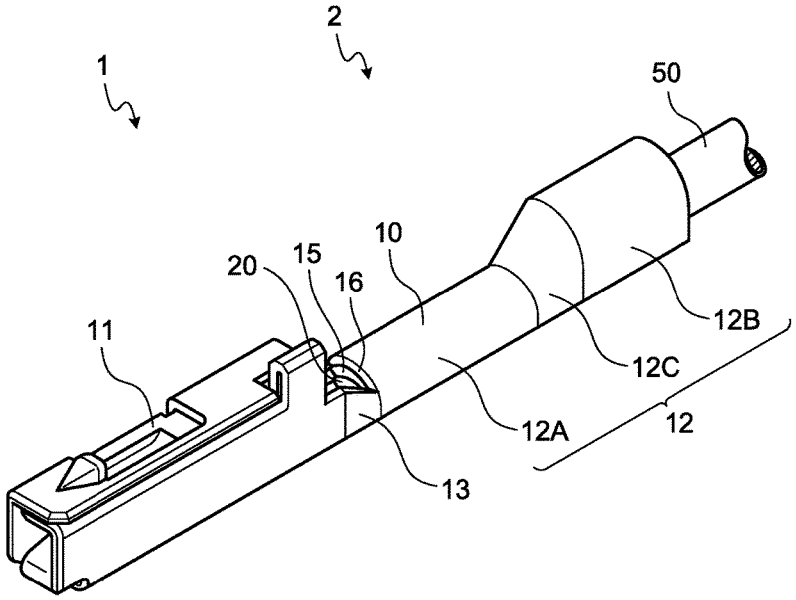
FIG. 3 is a perspective view illustrating the crimp terminal according to the embodiment after crimping.
Figure 4:
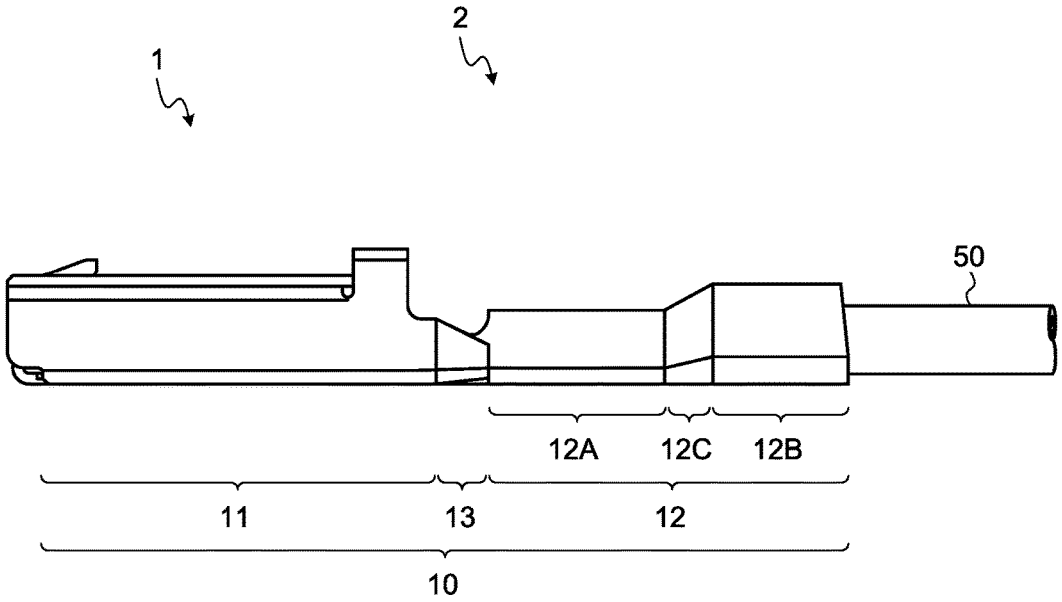
FIG. 4 is a side view illustrating the crimp terminal according to the embodiment after crimping.

The following describes an embodiment with reference to FIGS. 1 to 29. The embodiment relates to an electric wire with a terminal and a terminal crimping apparatus. FIG. 1 is a perspective view illustrating a state of a crimp terminal according to the embodiment before crimping, FIG. 2 is a side view illustrating a state of the crimp terminal according to the embodiment before crimping, and FIG. 3 is a perspective view illustrating the crimp terminal according to the embodiment after crimping.

First, the following describes a crimp terminal 1 according to the embodiment. The crimp terminal 1 illustrated in FIG. 1, for example, is a terminal to be crimped onto an electric wire 50. The crimp terminal 1 is electrically connected to a counterpart terminal (not illustrated) integrally with the electric wire 50. A coating 52 at an end of the electric wire 50 as a crimping target is removed, and a predetermined length of core wire 51 is exposed. The core wire 51 may be an assembly of a plurality of elemental wires, or a solid wire such as a coaxial cable. The crimp terminal 1 is crimped onto the end of the electric wire 50 to be electrically connected to the exposed core wire 51.

The crimp terminal 1 has a terminal metal fitting 10 and a water stop member 20. The terminal metal fitting 10 is a main body portion of the crimp terminal 1. The terminal metal fitting 10 is made of a conductive metal plate (for example, a copper plate, and a copper alloy plate) as a base material. The terminal metal fitting 10 is formed in a predetermined shape that can be connected to the counterpart terminal or the electric wire 50 through a punching process, a bending process, and the like performed on the base material. The terminal metal fitting 10 includes a terminal connection part 11 and an electric wire connection part 12. The terminal connection part 11 is a portion electrically connected to the counterpart terminal. The electric wire connection part 12 is a portion crimped onto the electric wire 50, and electrically connected to the core wire 51.

A coupling part 13 is arranged between the terminal connection part 11 and the electric wire connection part 12. In other words, the terminal connection part 11 is coupled to the electric wire connection part 12 via the coupling part 13. The coupling part 13 includes side walls 13*a*, 13*a* that connect side walls 11*a*, 11*a* of the terminal connection part 11 with barrel piece parts 15, 16 serving as side walls of the electric wire connection part 12. One of the side walls 13*a* connects one of the side walls 11*a* with a first barrel piece part 15, and the other one of the side walls 13*a* connects the other one of the side walls 11*a* with a second barrel piece part 16. The height of the side wall 13*a* is lower than the height of the barrel piece parts 15, 16 and the side wall 11*a*. More specifically, the height of the side wall 13*a* becomes lower from the terminal connection part 11 toward the electric wire connection part 12.

The terminal metal fitting 10 may be a male terminal or a female terminal. When the terminal metal fitting 10 is a male terminal, the terminal connection part 11 is molded in a male shape, and when the terminal metal fitting 10 is a female terminal, the terminal connection part 11 is molded in a female shape.

In the description about the crimp terminal 1, a connecting direction with respect to the counterpart terminal, that is, an inserting direction with respect to the counterpart terminal is referred to as a first direction L. The first direction L is a longitudinal direction of the crimp terminal 1. A parallel arrangement direction of the crimp terminal 1 is referred to as a second direction W. The parallel arrangement direction is, as described later, a direction in which crimp terminals 1 are arranged in parallel in the terminal chain body 30, and is a width direction of the crimp terminal 1. In the crimp terminal 1, direction orthogonal to both of the first direction L and the second direction W is referred to as a third direction H. The third direction H is a height direction of the crimp terminal 1.

At a molding step, the crimp terminal 1 is molded in a flat plate shape, and from this state, the terminal connection part 11 is formed in a cylindrical shape as illustrated in FIG. 1 at a step of forming the terminal connection part. At the step of forming the terminal connection part, a bending process and the like are performed on the terminal connection part 11. The terminal connection part 11 according to the embodiment is formed in a cylindrical shape having a rectangular cross section. The electric wire connection part 12 is molded to have a U-shaped cross section at a step of forming the electric wire connection part. A bending process and the like are performed on the electric wire connection part 12 at the step of forming the electric wire connection part. The water stop member 20 is attached to the electric wire connection part 12 at an attaching step. The attaching step may be performed before the step of forming the electric wire connection part, or may be performed after the step of forming the electric wire connection part.

Figure 6:
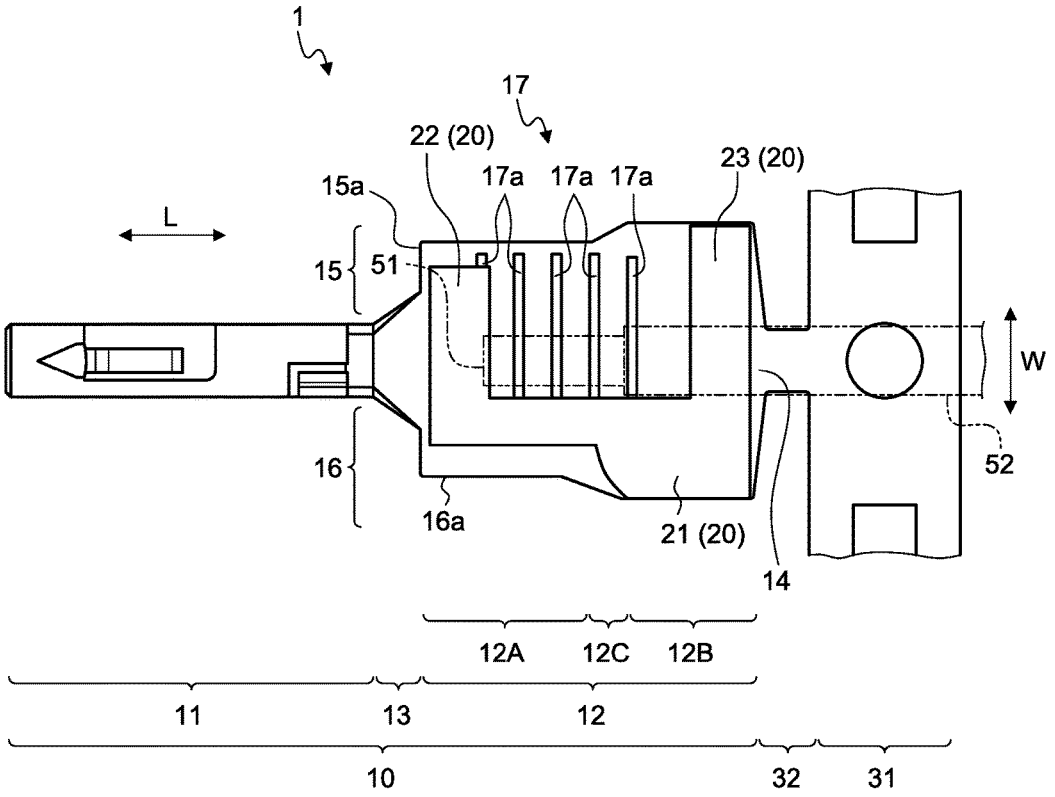
FIG. 6 is a plan view illustrating a state of the crimp terminal according to the embodiment in which a water stop member is attached thereto.

As illustrated in FIG. 1 and FIG. 6, the electric wire connection part 12 includes a bottom part 14, the first barrel piece part 15, and the second barrel piece part 16. The bottom part 14 is a part serving as a bottom wall of the electric wire connection part 12 formed in a U-shape. The end of the electric wire 50 is placed on the bottom part 14 in a crimping process. The first barrel piece part 15 and the second barrel piece part 16 serve as side walls of the electric wire connection part 12 formed in a U-shape. The first barrel piece part 15 and the second barrel piece part 16 are connected to ends in the second direction W of the bottom part 14. The first barrel piece part 15 and the second barrel piece part 16 project from the ends in the width direction of the bottom part 14 in a direction intersecting with the width direction. In the electric wire connection part 12 formed in a U-shape, when the end of the electric wire 50 is placed on the bottom part 14, the first barrel piece part 15 and the second barrel piece part 16 surround the electric wire 50 from both sides in the second direction W.

Regarding the first barrel piece part 15 and the second barrel piece part 16, a length from a base on the bottom part 14 side to an end face of the distal end 15*a* may be equal to a length from the base to an end face of the distal end 16*a*, or one of the lengths may be longer than the other one thereof. In the crimp terminal 1 according to the embodiment, the length from the base to the distal end 16*a* of the second barrel piece part 16 is longer than the length from the base to the distal end 15*a* of the first barrel piece part 15. The first barrel piece part 15 and the second barrel piece part 16 are wound around the electric wire 50 being overlapped with each other, for example. In the embodiment, the second barrel piece part 16 is overlapped with the outside of the first barrel piece part 15. Swaging, what is called B-crimp, may be performed on the first barrel piece part 15 and the second barrel piece part 16. In the B-crimp, each of the first barrel piece part 15 and the second barrel piece part 16 is bent toward the bottom part 14 side, and the distal ends 15*a* and 16*a* are swaged to be pressed against the electric wire 50. The water stop member 20 (described later) is arranged in the crimp terminal 1 according to the embodiment, so that former swaging processing is employed.

The end of the electric wire 50 is inserted through a U-shaped opening of the electric wire connection part 12, that is, a gap between the distal ends 15*a* and 16*a* into a U-shaped inner space. The electric wire connection part 12 is formed so that the end of the electric wire 50 can be easily inserted. Specifically, in the electric wire connection part 12, an interval in the second direction W between the first barrel piece part 15 and the second barrel piece part 16 is lengthened from the bottom part 14 side toward the end faces of the distal ends 15*a* and 16*a*.

As illustrated in FIGS. 2 to 6, in the first barrel piece part 15 and the second barrel piece part 16, a coupling crimping part 12C is interposed between a core wire crimping part 12A and a coating crimping part 12B. Each of the first barrel piece part 15 and the second barrel piece part 16 is a piece part in which the crimping parts 12A, 12C, and 12B are continuously arranged along the first direction L in this order.

The core wire crimping part 12A is a part crimped onto the core wire 51 at the distal end of the electric wire 50. The core wire crimping part 12A is a part of each of the barrel piece parts 15 and 16 closest to the coupling part 13. The coating crimping part 12B is a part crimped onto the end of the coating 52. The coating crimping part 12B is a part of each of the barrel piece parts 15 and 16 positioned on the farthest side from the coupling part 13 side. The coupling crimping part 12C is a part for connecting the core wire crimping part 12A with the coating crimping part 12B. The coupling crimping part 12C is crimped onto a boundary portion between the core wire 51 and the coating 52 of the electric wire 50. The electric wire connection part 12 is crimped onto the electric wire 50 to integrally cover the core wire 51 and the coating 52. When the electric wire connection part 12 is wound around and crimped onto the electric wire 50, an electric wire 2 with a terminal illustrated in FIGS. 3 and 4, for example, is formed.

Figure 5:
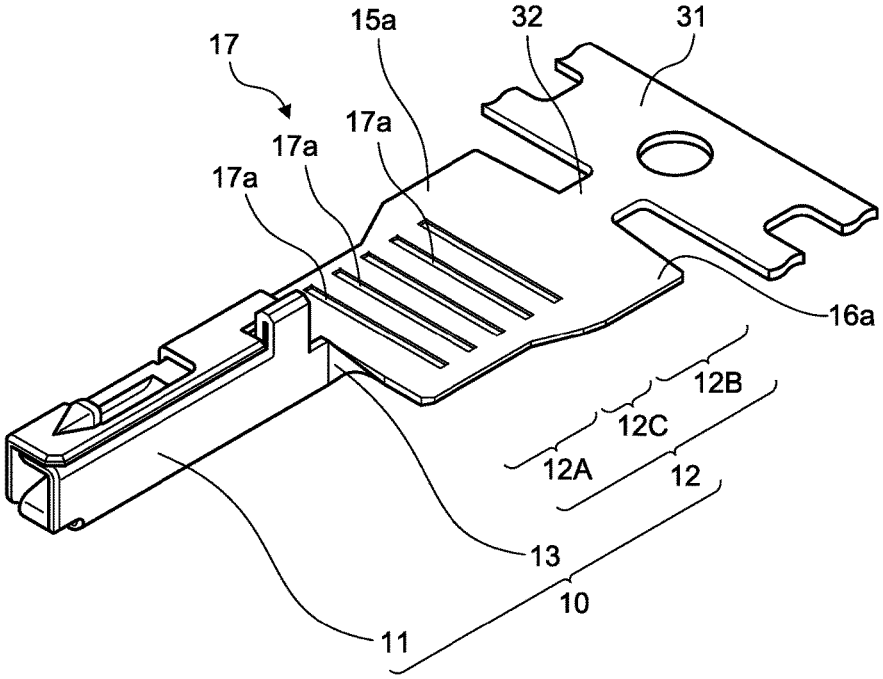
FIG. 5 is a perspective view illustrating a state of the crimp terminal according to the embodiment before an attaching step is performed.

As illustrated in FIGS. 5 and 6, a serration region 17 is arranged on an inner wall surface of the electric wire connection part 12, that is, a wall surface on a side for covering the electric wire 50. The serration region 17 is a core wire holding region for holding the core wire 51. The serration region 17 is a region including a portion wound around the core wire 51 on the inner wall surface of the electric wire connection part 12. In the serration region 17, arranged are a plurality of recessed parts, a plurality of projecting parts, or a combination of the recessed part and the projecting part. The recessed part and the projecting part increase a contact area between the electric wire connection part 12 and the core wire 51, and enhance adhesive strength therebetween. The serration region 17 according to the embodiment is a rectangular region, and a plurality of recessed parts 17*a* are formed at different positions in the first direction L.

It is not preferable that water enters between the core wire 51 and the electric wire connection part 12 crimped onto the core wire 51. For example, in a case in which a metallic material of the core wire 51 and a metallic material of the electric wire connection part 12 have different ionization tendencies, corrosion may be caused. By way of example, in a case in which the material of the core wire 51 is aluminum and the material of the electric wire connection part 12 is copper, the core wire 51 may be corroded. The water stop member 20 is arranged in the crimp terminal 1 according to the embodiment. The water stop member 20 prevents water from entering between the electric wire connection part 12 and the core wire 51.

The water stop member 20 is, for example, a member formed in a sheet shape mainly made of an adhesive such as an acrylic adhesive. As the water stop member 20 according to the embodiment, used is an adhesive sheet formed by impregnating a sheet-like nonwoven fabric with an adhesive, which has an adhesive effect on both surfaces thereof.

The water stop member 20 is, for example, attached to the inner wall surface of the electric wire connection part 12 having a flat plate shape illustrated in FIG. 5. As illustrated in FIG. 6, the water stop member 20 is formed in a predetermined shape, and includes a first water stop part 21, a second water stop part 22, and a third water stop part 23. The first water stop part 21 stops water at a portion where the first barrel piece part 15 is overlapped with the second barrel piece part 16 after crimping is completed. That is, the first water stop part 21 is sandwiched between the first barrel piece part 15 and the second barrel piece part 16 overlapping with each other, and forms a water stop region between the barrel piece parts 15 and 16. The first water stop part 21 according to the embodiment is arranged on the second barrel piece part 16, and extends along the first direction L.

The second water stop part 22 stops water at a position closer to the terminal connection part 11 side than the distal end of the core wire 51. The second water stop part 22 is arranged at an end of the electric wire connection part 12 on the terminal connection part 11 side, and extends along the second direction W. At least part of the second water stop part 22 is desirably arranged in a region in which the core wire 51 is placed. The second water stop part 22 is, for example, sandwiched between the barrel piece parts 15 and 16 overlapping with each other to form a water stop region in a gap between the barrel piece parts 15 and 16. The second water stop part 22 can block a gap closer to the terminal connection part 11 than the distal end of the core wire 51 when the barrel piece parts 15 and 16 are overlapped with each other at a crimping step. The second water stop part 22 prevents water from entering between the electric wire connection part 12 and the core wire 51 from the terminal connection part 11 side.

The third water stop part 23 prevents entrance of water from a gap between the electric wire connection part 12 and the coating 52. The third water stop part 23 is arranged at an end of the electric wire connection part 12 opposite to the terminal connection part 11 side, and extends along the second direction W. The third water stop part 23 is sandwiched between the coating 52 and the electric wire connection part 12 to form a water stop region between the coating 52 and the electric wire connection part 12.

The terminal metal fitting 10 described above is processed into a form of including the electric wire connection part 12 having a flat plate shape illustrated in FIG. 5 through a pressing step performed on one metal plate as a base material. At the attaching step thereafter, the water stop member 20 is attached to the electric wire connection part 12 having a flat plate shape. Thereafter, at a bending step of the terminal metal fitting 10, the terminal connection part 11 is formed, and the electric wire connection part 12 having a U-shape is formed.

Figure 7:
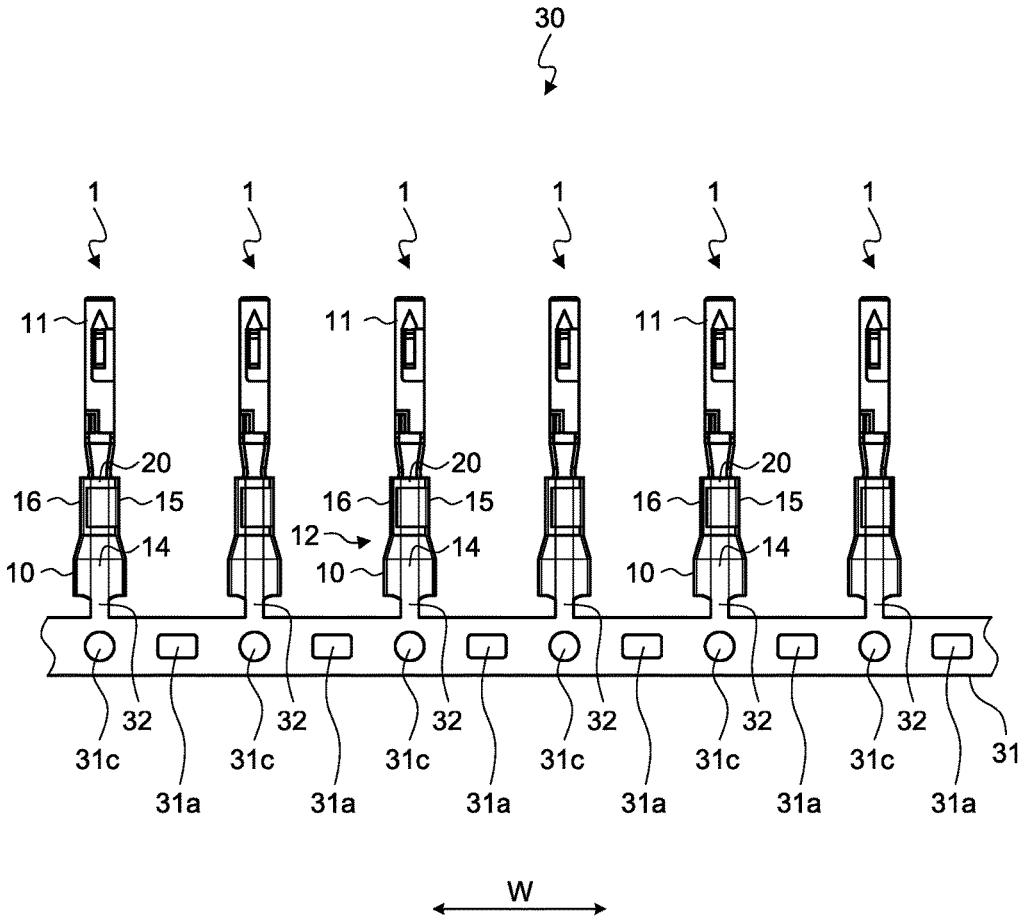
FIG. 7 is a plan view illustrating a terminal chain body according to the embodiment.

In the embodiment, the terminal chain body 30 illustrated in FIG. 7 is formed through the pressing step and the bending step. The terminal chain body 30 is a chain of a plurality of crimp terminals 1, and is formed of one metal plate. The terminal chain body 30 is supplied to a terminal crimping apparatus 100. The terminal crimping apparatus 100 executes a crimping step and a terminal cutting step on the terminal chain body 30. The crimping step is a step of swaging and crimping the crimp terminal 1 of the terminal chain body 30 onto the electric wire 50. The terminal cutting step is a step of cutting off the crimp terminal 1 swaged onto the electric wire 50 from the terminal chain body 30.

The terminal chain body 30 is an assembly of the crimp terminals 1. The terminal chain body 30 includes a coupling piece 31, the crimp terminals 1, and a plurality of connecting parts 32. The coupling piece 31, the crimp terminal 1, and the connecting part 32 are integrally formed of the same base material. In the terminal chain body 30, the respective crimp terminals 1 are oriented in the same direction, and arranged in parallel at regular intervals. In the terminal chain body 30, ends on one side of the crimp terminals 1 are connected to each other via the coupling piece 31. The coupling piece 31 has, for example, a long and narrow rectangular plate shape. The coupling piece 31 extends along the second direction W. The electric wire connection part 12 is connected to the coupling piece 31 via the connecting part 32. More specifically, the connecting part 32 connects an end of the bottom part 14 opposite to the terminal connection part 11 side to the coupling piece 31.

A plurality of terminal feed holes 31*a* are formed in the coupling piece 31. The terminal feed holes 31*a* are arranged at regular intervals along a feed direction of the terminal chain body 30. The terminal feed hole 31*a* is a through hole passing through the coupling piece 31 in a plate thickness direction. The crimp terminal 1 is positioned with respect to a crimping device 102 (described later) by the terminal feed hole 31*a*. The terminal chain body 30 is set to the terminal crimping apparatus 100 in a state of being wound in a reel shape.

Figure 8:
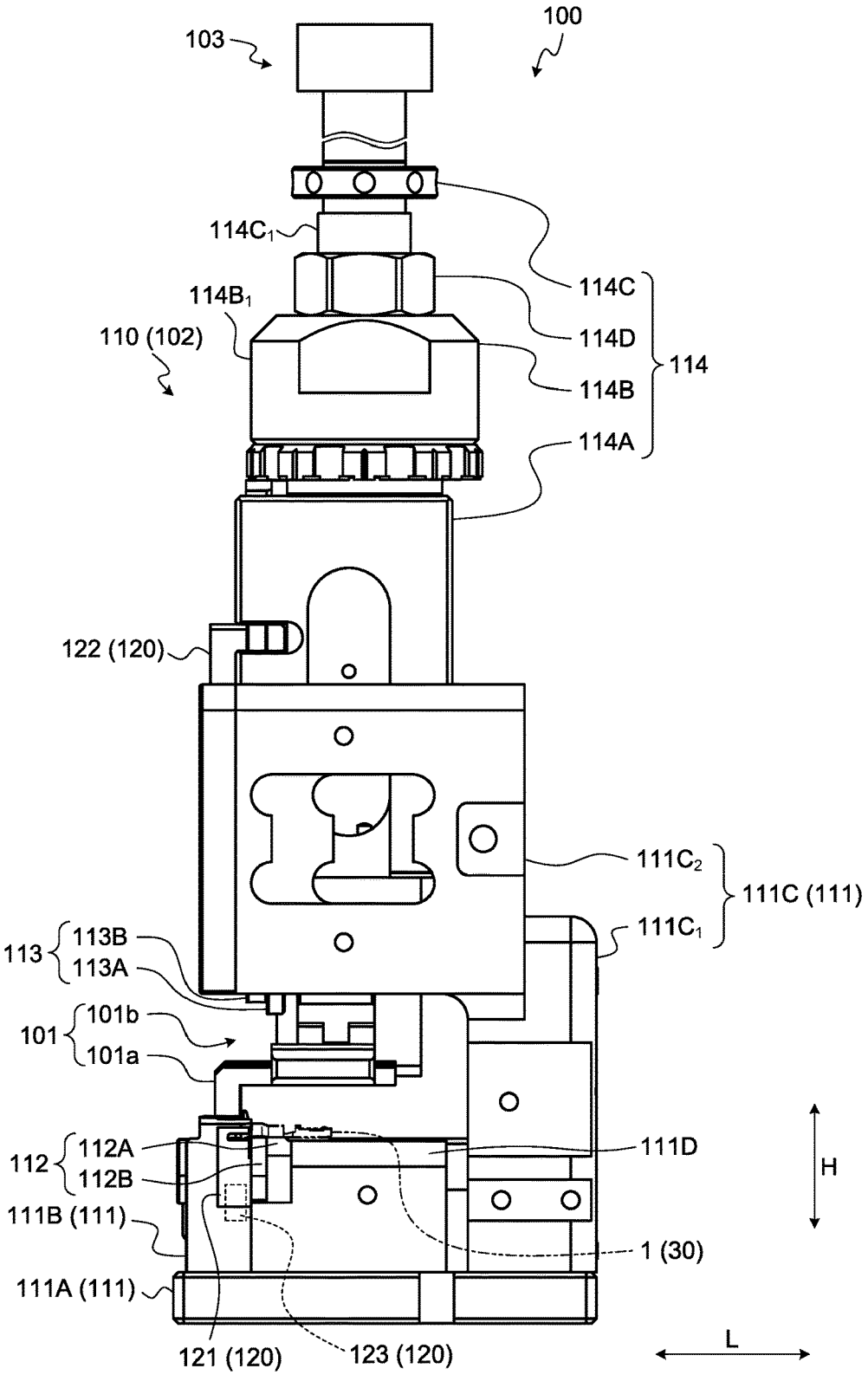
FIG. 8 is a side view of a terminal crimping apparatus according to the embodiment.
Figure 9:
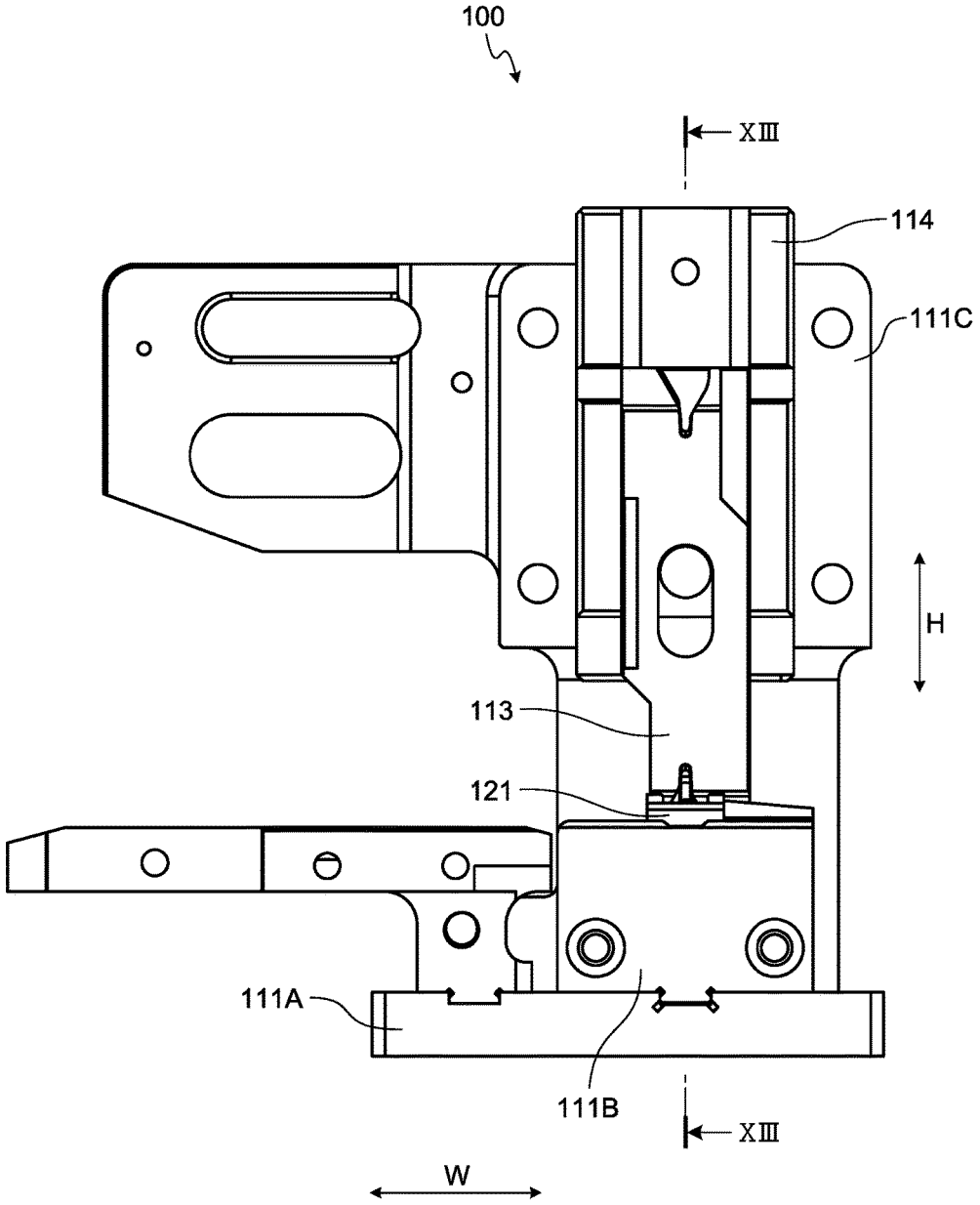
FIG. 9 is a front view of the terminal crimping apparatus according to the embodiment.

As illustrated in FIG. 8, the terminal crimping apparatus 100 includes a terminal supply device 101, a crimping device 102, and a drive device 103. The terminal crimping apparatus 100 is a device what is called an applicator in this technical field. The terminal supply device 101 is a device configured to supply the crimp terminal 1 to a predetermined crimping position. The crimping device 102 is a device configured to crimp the crimp terminal 1 onto the electric wire 50 at the predetermined crimping position. The drive device 103 is a device configured to cause the terminal supply device 101 and the crimping device 102 to operate.

The terminal supply device 101 successively draws out the terminal chain body 30 wound in a reel shape from an outer peripheral side. The terminal supply device 101 sequentially supplies, to the crimping position, the crimp terminals 1 of the drawn-out terminal chain body 30 from the top. When the top crimp terminal 1 is crimped onto the electric wire 50 and cut off from the coupling piece 31, the terminal supply device 101 supplies the crimp terminal 1 that newly becomes the foremost to the crimping position. The terminal supply device 101 performs a supply operation every time the crimping step and the terminal cutting step for each crimp terminal 1 are completed, and supplies the next crimp terminal 1 to the crimping position.

The terminal supply device 101 includes a terminal feed member 101*a* and a power transmission mechanism 101*b*. The terminal feed member 101*a* includes a projection part to be inserted into the terminal feed hole 31*a* of the coupling piece 31. The terminal feed member 101*a* moves the terminal chain body 30 in the feed direction in a state in which the projection part is inserted into the terminal feed hole 31*a*. The power transmission mechanism 101*b* causes the terminal feed member 101*a* to operate interlocked with a crimping operation (vertical motion of a ram 114A and the like described later) performed by the crimping device 102. The terminal supply device 101 moves the terminal feed member 101*a* in a vertical direction and the feed direction to supply the crimp terminal 1 to the crimping position interlocked with the crimping operation of the crimping device 102.

The crimping device 102 executes the crimping step of crimping the supplied crimp terminal 1 onto the electric wire 50, and the terminal cutting step of cutting off the crimp terminal 1 from the coupling piece 31. The crimping device 102 includes a crimping machine 110 and a terminal cutting mechanism 120.

The crimping machine 110 is a device configured to swage the crimp terminal 1 onto an end of the electric wire 50 to crimp the crimp terminal 1 onto the electric wire 50. The crimping machine 110 according to the embodiment swages the first barrel piece part 15 and the second barrel piece part 16 of the crimp terminal 1 onto the core wire 51 and the coating 52 of the electric wire 50 by winding the first barrel piece part 15 and the second barrel piece part 16 around the core wire 51 and the coating 52, thereby crimping the crimp terminal 1 onto the electric wire 50. The crimping machine 110 includes a frame 111, a first die 112, a second die 113, and a power transmission mechanism 114.

The frame 111 includes a base 111A, an anvil support 111B, a transmission part support 111C, and a support base 111D. The base 111A is a member serving as a foundation of the terminal crimping apparatus 100. The base 111A is fixed to a placing table on which the terminal crimping apparatus 100 is placed. The anvil support 111B, the transmission part support 111C, and the support base 111D are fixed onto the base 111A.

The transmission part support 111C is arranged in the rear of (the right side of FIG. 8) and above (on an upper side of FIG. 8) the anvil support 111B. More specifically, the transmission part support 111C includes an erected part 111$C_1$ and a ram supporting part 111$C_2$. The erected part 111$C_1$ is arranged in the rear of the anvil support 111B, and erected upward from the base 111A. The ram supporting part 111$C_2$ is held on an upper part of the erected part 111$C_1$. The ram supporting part 111$C_2$ is a supporting part configured to support the ram 114A described later. The ram supporting part 111$C_2$ is arranged above the anvil support 111B with a predetermined gap between itself and the anvil support 111B. The support base 111D is a base for supporting the terminal connection part 11 of the crimp terminal 1. A height position of an upper surface of the support base 111D is substantially the same as a height position of an upper surface of the first die 112.

Figure 10:
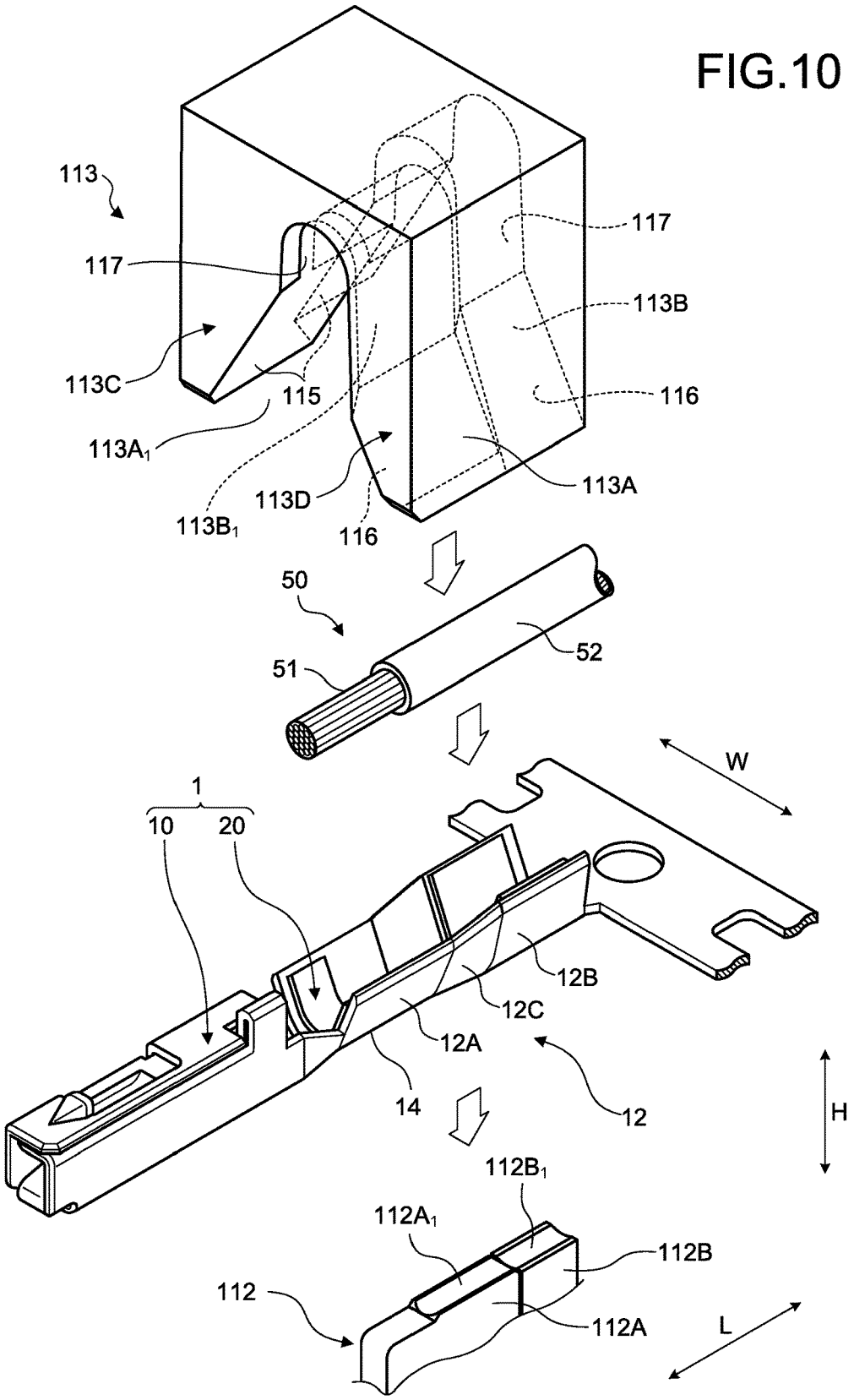
FIG. 10 is a perspective view illustrating first and second dies according to the embodiment.

The first die 112 is paired with the second die 113. The first die 112 and the second die 113 are arranged with an interval in the vertical direction. As illustrated in FIG. 10, the first die 112 and the second die 113 sandwich the crimp terminal 1 and the electric wire 50 therebetween to crimp the crimp terminal 1 onto the electric wire 50. The first die 112 is a die configured to support the crimp terminal 1 from below. The first die 112 includes two female molds formed therein, that is, a first anvil 112A serving as a first female mold, and a second anvil 112B serving as a second female mold. The first anvil 112A and the second anvil 112B are, for example, integrally formed. The second die 113 is arranged above the first die 112. The second die 113 includes two male molds, and includes a first crimper 113A serving as a first male mold and a second crimper 113B serving as a second male mold.

The first anvil 112A and the first crimper 113A are opposed to each other in the vertical direction. The first anvil 112A and the first crimper 113A cause the core wire crimping part 12A to be crimped onto the core wire 51 of the electric wire 50. That is, the first anvil 112A and the first crimper 113A reduce a gap therebetween to cause the U-shaped core wire crimping part 12A to be wound around and crimped onto the core wire 51.

The second anvil 112B and the second crimper 113B are opposed to each other in the vertical direction. The second anvil 112B and the second crimper 113B cause the coating crimping part 12B to be crimped onto the coating 52. That is, the second anvil 112B and the second crimper 113B reduce a gap therebetween to cause the U-shaped coating crimping part 12B to be wound around and crimped onto the coating 52.

The drive device 103 transmits power to the power transmission mechanism 114 to reduce the gap between the first die 112 and the second die 113 at the crimping step, and crimps the electric wire connection part 12 onto the electric wire 50. On the other hand, the drive device 103 widens the gap between the first die 112 and the second die 113 when the crimping step is completed. In the crimping device 102 according to the embodiment, the gap between the pair of dies 112 and 113 varies when the second die 113 vertically moves with respect to the first die 112.

The first anvil 112A may be separated from the second anvil 112B in the first die 112, and the first crimper 113A may be separated from the second crimper 113B in the second die 113. In this case, the drive device 103 and the power transmission mechanism 114 may be configured so that the first crimper 113A and the second crimper 113B are separately and vertically moved.

The power transmission mechanism 114 transmits the power output from the drive device 103 to the first crimper 113A and the second crimper 113B. As illustrated in FIG. 8, the power transmission mechanism 114 includes the ram 114A, a ram bolt 114B, and a shank 114C.

The ram 114A is a movable member that is supported by the ram supporting part 111$C_2$ to be freely movable in the vertical direction. The second die 113 is fixed to the ram 114A. Thus, the first crimper 113A and the second crimper 113B vertically move with respect to the ram supporting part 111$C_2$ integrally with the ram 114A. The ram 114A has, for example, a rectangular solid shape. A female screw part (not illustrated) is formed on the ram 114A. The female screw part is formed on an inner peripheral surface of a hole in the vertical direction formed from the inside of the ram 114A toward an upper end face.

The ram bolt 114B includes a male screw part (not illustrated), which is screwed to the female screw part of the ram 114A. Thus, the ram bolt 114B vertically moves with respect to the ram supporting part 111$C_2$ integrally with the ram 114A. The ram bolt 114B also includes a bolt head part 114$B_2$ arranged above the male screw part thereof. A female screw part (not illustrated) is formed on the bolt head part 114$B_1$. The female screw part of the bolt head part 114$B_2$ is formed on an inner peripheral surface of the hole in the vertical direction that is formed from the inside of the bolt head part 114$B_1$ toward the upper end face.

The shank 114C is a cylindrical hollow member, and includes a male screw part 114$C_1$ and a connection part (not illustrated) at respective ends thereof. The male screw part 114$C_1$ of the shank 114C is formed below the hollow member, and screwed to the female screw part of the bolt head part 114$B_1$ of the ram bolt 114B. Accordingly, the shank 114C vertically moves with respect to the ram supporting part 111$C_2$ integrally with the ram 114A and the ram bolt 114B. The connection part of the shank 114C is connected to the drive device 103.

The drive device 103 includes a driving source (not illustrated), and a power converting mechanism (not illustrated) configured to convert driving force of the driving source into power in the vertical direction. The connection part of the shank 114C is coupled to an output shaft of the power converting mechanism. Accordingly, the first crimper 113A and the second crimper 113B vertically move with respect to the ram supporting part 111$C_2$ integrally with the ram 114A, the ram bolt 114B, and the shank 114C by an output from the drive device 103 (output from the power converting mechanism). As the driving source of the drive device 103, an electric actuator such as an electric motor, a hydraulic actuator such as a hydraulic cylinder, a pneumatic actuator such as an air cylinder, and the like can be applied.

A relative position of the first crimper 113A in the vertical direction with respect to the first anvil 112A and a relative position of the second crimper 113B in the vertical direction with respect to the second anvil 112B can be changed by adjusting a screwing amount of the female screw part of the bolt head part 114$B_1$ and the male screw part 114$C_1$ of the shank 114C. A nut 114D is screwed to the male screw part 114$C_1$ of the shank 114C above the ram bolt 114B. Accordingly, the nut 114D serves a function of what is called a locknut together with the female screw part of the bolt head part 114$B_1$. When the nut 114D is tightened toward the ram bolt 114B after the relative position described above is completely adjusted, the first crimper 113A and the second crimper 113B can be fixed to the relative position.

As illustrated in FIG. 10, recessed surfaces 112$A_1$ and 112$B_1$, which are recessed downward, are formed at respective upper distal ends of the first anvil 112A and the second anvil 112B. The respective recessed surfaces 112$A_1$ and 112$B_1$ are formed to have an arc-shaped cross section corresponding to the shape of the bottom part 14 of the U-shaped core wire crimping part 12A and the U-shaped coating crimping part 12B. In the crimping machine 110, the respective recessed surfaces 112$A_1$ and 112$B_1$ are crimping positions. In the crimp terminal 1 supplied with the bottom part 14 facing downward, the bottom part 14 of the core wire crimping part 12A is placed on the recessed surface 112$A_1$ of the first anvil 112A, and the bottom part 14 of the coating crimping part 12B is placed on the recessed surface 112$B_1$ of the second anvil 112B. The first die 112 is supported by the anvil support 111B in a state in which the recessed surfaces 112$A_1$ and 112$B_1$ are exposed upward.

As illustrated in FIG. 10, recessed parts 113$A_1$ and 113$B_1$ that are recessed upward are formed on the respective first crimper 113A and the second crimper 113B. The respective recessed parts 113$A_1$ and 113$B_1$ are arranged to be opposed to the recessed surfaces 112$A_1$ and 112$B_1$ of the first anvil 112A and the second anvil 112B in the vertical direction. Each of the recessed parts 113$A_1$ and 113$B_1$ includes first and second wall surfaces 115 and 116, and a third wall surface 117. The first wall surface 115 and the second wall surface 116 are opposed to each other in the second direction W. The third wall surface 117 connects upper ends of the first and second wall surfaces 115 and 116. The recessed parts 113$A_1$ and 113$B_1$ cause the first barrel piece part 15 and the second barrel piece part 16 to be wound around the end of the electric wire 50 to be swaged while bringing the first to third wall surfaces 115, 116, and 117 into contact with the first barrel piece part 15 and the second barrel piece part 16. The recessed parts 113$A_1$ and 113$B_1$ are formed to be able to perform such a swaging operation.

The crimp terminal 1 on which the crimping process is performed by the crimping machine 110 is cut off from the coupling piece 31 by the terminal cutting mechanism 120. The terminal cutting mechanism 120 cuts off the connecting part 32 of the crimp terminal 1 supplied to the crimping position by sandwiching the connecting part 32 with two terminal cutting parts. The cutting off is performed interlocked with the progress of the crimping step. As illustrated in FIG. 8, the terminal cutting mechanism 120 is arranged in front of the second anvil 112B (the left side of FIG. 8). The terminal cutting mechanism 120 includes a terminal cut body 121, a pressing-down member 122, and an elastic member 123.

Figure 11:
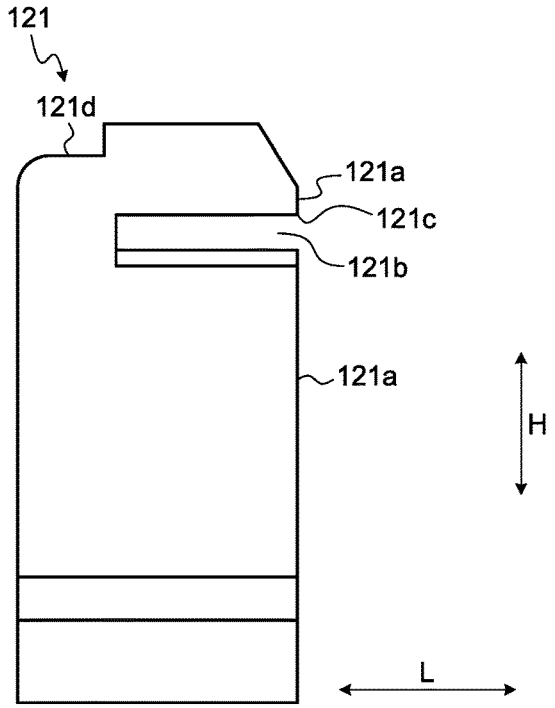
FIG. 11 is a side view illustrating a terminal cut body according to the embodiment.
Figure 12:
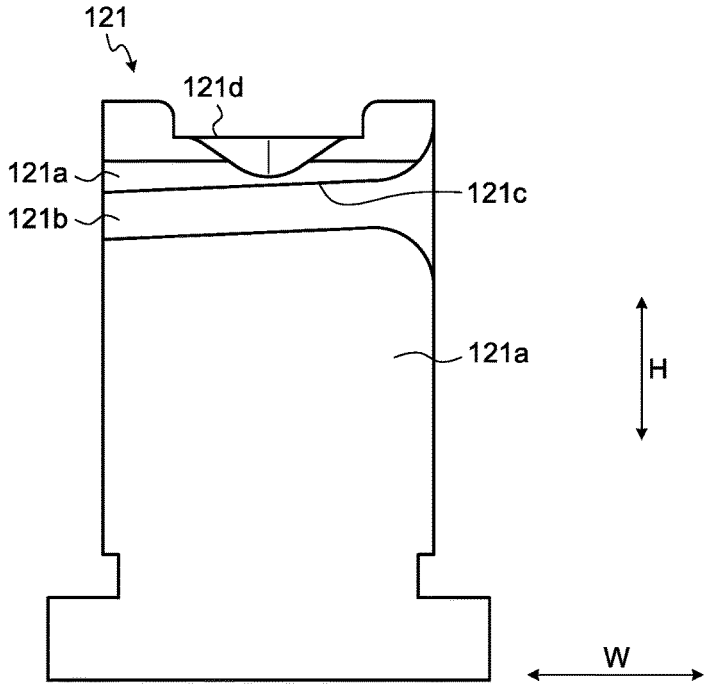
FIG. 12 is a back view illustrating the terminal cut body according to the embodiment.

The terminal cut body 121 is formed in a rectangular solid shape, and arranged to be slidable in the vertical direction along a front surface of the second anvil 112B. As illustrated in FIGS. 11 and 12, a slit 121*b* is formed from a sliding contact surface 121*a* with respect to the second anvil 112B toward the inside of the terminal cut body 121. The slit 121*b* is a passage for the coupling piece 31 of the terminal chain body 30. When the crimp terminal 1 as a crimping target is supplied to the crimping position, the crimp terminal 1 projects from the slit 121*b*. The crimp terminal 1 supplied to the crimping position is supported by the first die 112 from below.

Figure 13:
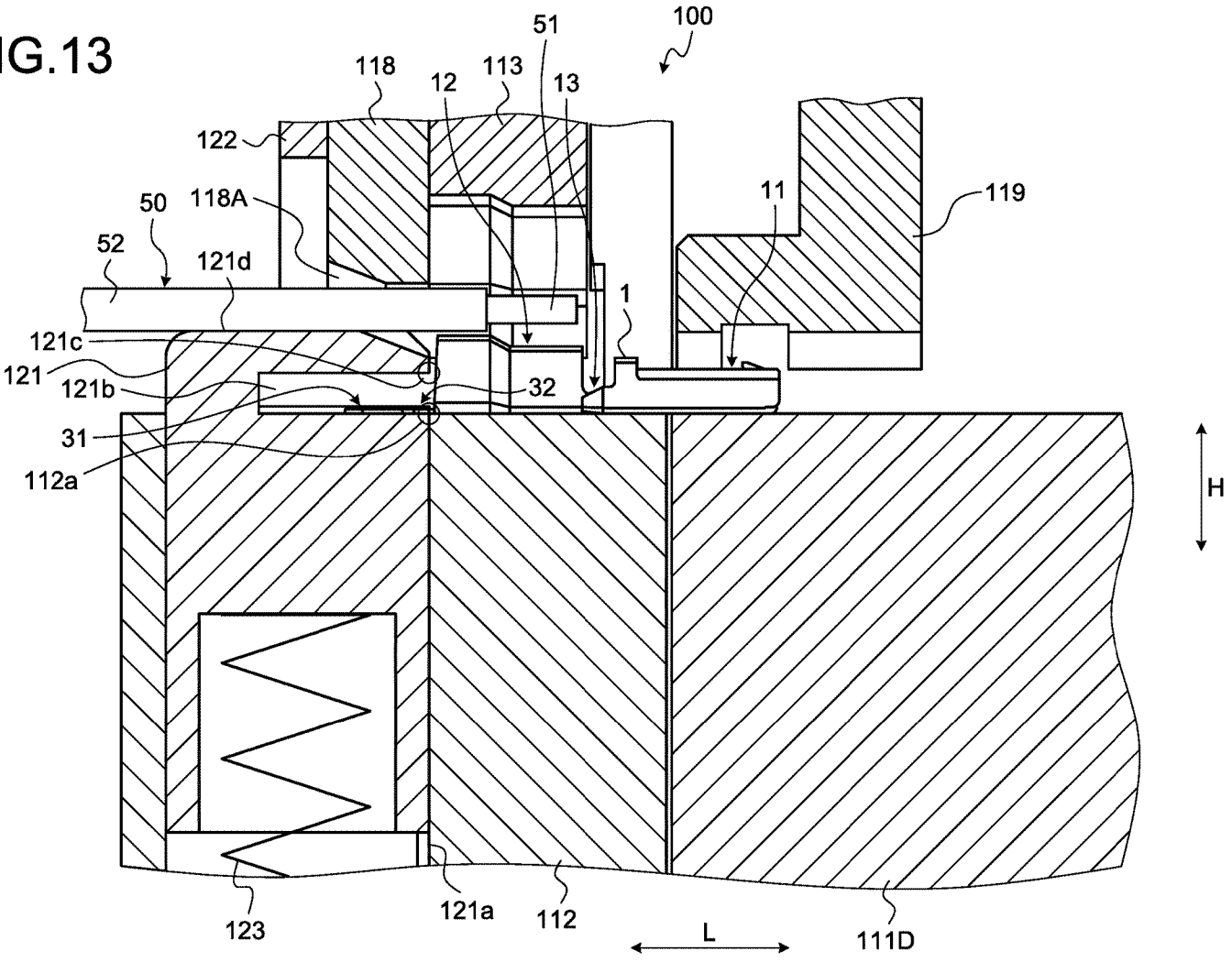
FIG. 13 is a cross-sectional view illustrating a state in which an electric wire and a crimp terminal are set to the terminal crimping apparatus according to the embodiment.

The terminal cut body 121 cuts off the connecting part 32 while vertically moving relatively to the first die 112 and the crimp terminal 1. A position where the coupling piece 31 and the like can be inserted into the slit 121*b* is assumed to be an initial position in the vertical direction of the terminal cut body 121. As illustrated in FIG. 13, an end of the connecting part 32 on the electric wire connection part 12 is positioned at an opening on the sliding contact surface 121*a* side (that is, the crimp terminal 1 side) of the slit 121*b*. In the terminal cut body 121, an upper edge part of the opening (hereinafter, referred to as an "opening edge") 121*c* is used as one of the terminal cutting parts. The other one of the terminal cutting parts is an upper surface edge 112*a* of the second anvil 112B.

The pressing-down member 122 is fixed to the ram 114A, and vertically moves integrally with the ram 114A. The pressing-down member 122 is arranged above the terminal cut body 121, and lowers down to press down the terminal cut body 121. The pressing-down member 122 is formed in a rectangular solid shape. The elastic member 123 applies upward urging force to the terminal cut body 121, and is made of a spring member and the like. When pressing-down force from the pressing-down member 122 is released, the elastic member 123 returns the terminal cut body 121 to an initial position in the vertical direction.

In the terminal cutting mechanism 120, the pressing-down member 122 lowers down following the second die 113 that lowers down in the crimping process, and presses down the terminal cut body 121. When the terminal cut body 121 lowers down, the connecting part 32 is sandwiched between the opening edge 121*c* of the slit 121*b* and the upper surface edge 112*a* (FIG. 13) of the second anvil 112B. In the terminal cutting mechanism 120, the opening edge 121*c* and the upper surface edge 112*a* function as scissors, and apply shearing force to the connecting part 32. When the terminal cut body 121 is further pressed down, the opening edge 121*c* and the upper surface edge 112*a* cut off the connecting part 32 to cut off the crimp terminal 1 from the coupling piece 31. To improve cutting property, the opening edge 121*c* is inclined with respect to the upper surface edge 112*a* on the sliding contact surface 121*a*.

As illustrated in FIG. 13, the electric wire 50 as a crimping target is arranged at a predetermined position between the terminal cut body 121 and the pressing-down member 122. The electric wire 50 is, specifically, placed on an upper surface 121*d* of the terminal cut body 121. Thus, a clearance for the electric wire 50 is arranged in at least one of an upper part of the terminal cut body 121 and a lower part of the pressing-down member 122 so that the electric wire 50 is not crushed therebetween.

Herein, the predetermined position is a position for placing the end of the electric wire 50 before the crimping process above the bottom part 14 of the electric wire connection part 12 having a flat plate shape. The predetermined position is a position for enabling the core wire 51 to be placed on the bottom part 14 of the core wire crimping part 12A so that the distal end of the core wire 51 that is pressed down when the crimping process is started does not protrude from the core wire crimping part 12A. The core wire 51 may stretch in an axial direction in accordance with the crimping process, and the distal end position of the core wire 51 may move along the axial direction. The predetermined position is preferably determined considering such a stretch.

On the other hand, the end (the core wire 51 or the coating 52 at the distal end) of the electric wire 50 is pressed down toward the inner wall surface of the electric wire connection part 12 by the second die 113. The electric wire 50 rises from the upper surface 121*d* of the terminal cut body 121 if the electric wire 50 is not held at all, and the core wire 51 or the coating 52 at the distal end thereof may be crimped in a state of not being placed on the bottom part 14 of the electric wire connection part 12. Thus, in the terminal crimping apparatus 100 according to the embodiment, an electric wire holding mechanism is arranged for holding the electric wire 50 at a predetermined position between itself and an upper part of the terminal cut body 121 and preventing misalignment of the end of the electric wire 50 with respect to the electric wire connection part 12 during the crimping process.

The electric wire holding mechanism includes an electric wire retainer 118 configured to press and hold, against the upper surface 121*d*, the electric wire 50 placed on the upper surface 121*d* of the terminal cut body 121 serving as an electric wire placement part (FIG. 13). The electric wire retainer 118 is arranged above the terminal cut body 121 and between the second die 113 and the pressing-down member 122. A space 118A for holding the coating 52 of the electric wire 50 (hereinafter, referred to as an "electric wire holding space") is formed between the upper surface 121*d* of the terminal cut body 121 and the lower surface of the electric wire retainer 118. For example, the electric wire retainer 118 is fixed to the ram 114A, and vertically moves integrally with the ram 114A. The electric wire 50 is held in the electric wire holding space 118A that is formed in accordance with lowering of the electric wire retainer 118.

The terminal crimping apparatus 100 according to the embodiment includes a supporting stopper 119. The supporting stopper 119 supports the terminal connection part 11 of the crimp terminal 1 at the crimping step. The supporting stopper 119 is arranged at a position opposed to the terminal connection part 11 in the third direction H. The supporting stopper 119 is a member that is supported by the ram 114A and moves integrally with the ram 114A. The supporting stopper 119 lowers down interlocked with lowering of the ram 114A, and covers the terminal connection part 11 from above. The supporting stopper 119 covering the terminal connection part 11 supports the terminal connection part 11, and suppresses movement of the terminal connection part 11 such as rolling or twisting. Herein, rolling means rotational movement about an axis along the first direction L, and twisting means inclined movement with respect to the first direction L.

Figure 14:
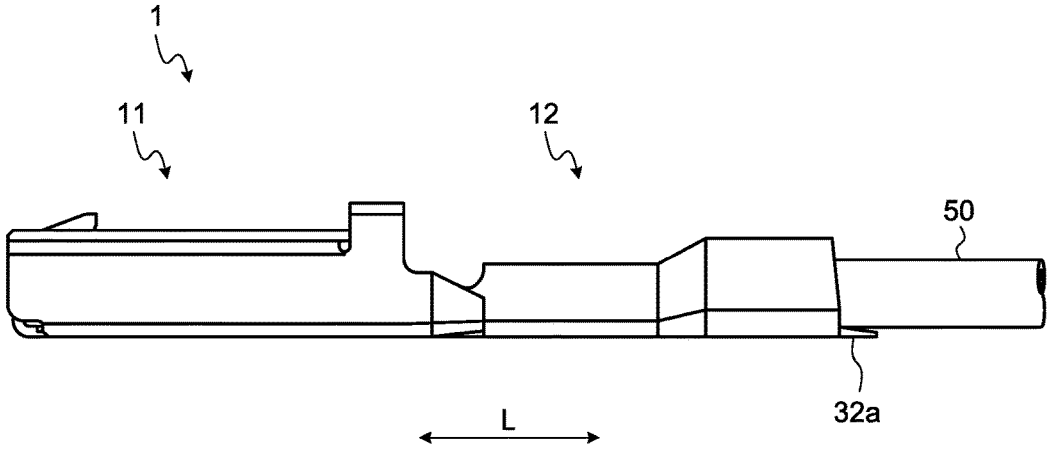
FIG. 14 is a side view illustrating a cutoff left at the crimp terminal.

As described above, the terminal crimping apparatus 100 according to the embodiment crimps the electric wire connection part 12 onto the electric wire 50, and cuts off the crimp terminal 1 from the terminal chain body 30. As illustrated in FIG. 14, when a cutoff 32*a* as part of the connecting part 32 is left in the crimp terminal 1 cut off from the terminal chain body 30, a problem as described below may be caused. At the time when the crimp terminal 1 is crimped onto the electric wire 50, the electric wire connection part 12 stretches along the first direction L. When the electric wire connection part 12 stretches and the cutoff 32*a* is left in the electric wire connection part 12, the cutoff 32*a* may project from a terminal accommodating part. The terminal accommodating part is, for example, a cavity formed in an electric connection box and the like. It is not preferable that the cutoff 32*a* projects from the terminal accommodating part in a state in which the crimp terminal 1 is accommodated in the terminal accommodating part.

Figure 15:
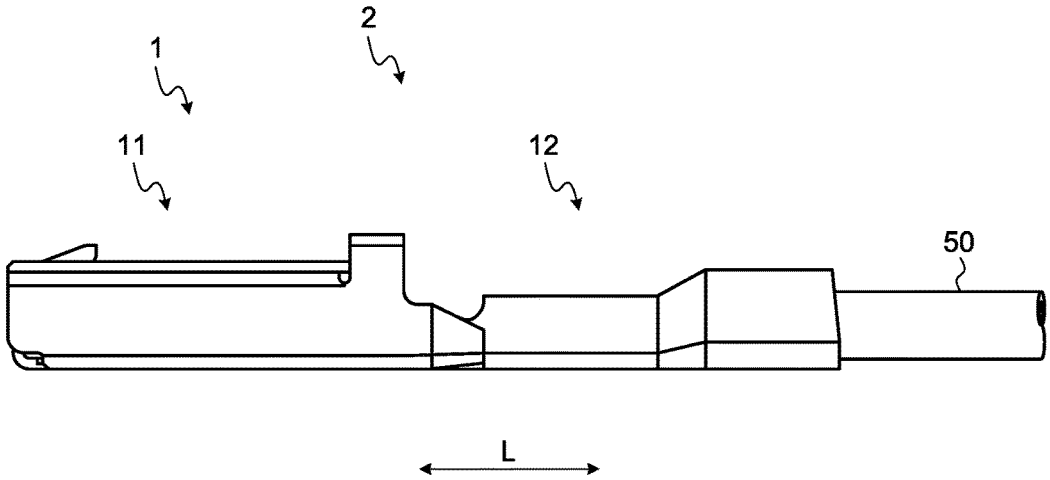
FIG. 15 is a side view illustrating the crimp terminal according to the embodiment cut off from the terminal chain body.

The terminal crimping apparatus 100 according to the embodiment is configured to cut off a boundary between the connecting part 32 and the crimp terminal 1. The terminal cutting mechanism 120 of the terminal crimping apparatus 100 cuts off the crimp terminal 1 to cause the cutoff 32*a* to be substantially 0 as illustrated in FIG. 15. Accordingly, the cutoff 32*a* is prevented from projecting from the terminal accommodating part. Additionally, the second die 113 of the terminal crimping apparatus 100 according to the embodiment is configured to eliminate a swaging residue of the electric wire connection part 12 as described below.

Figure 16:
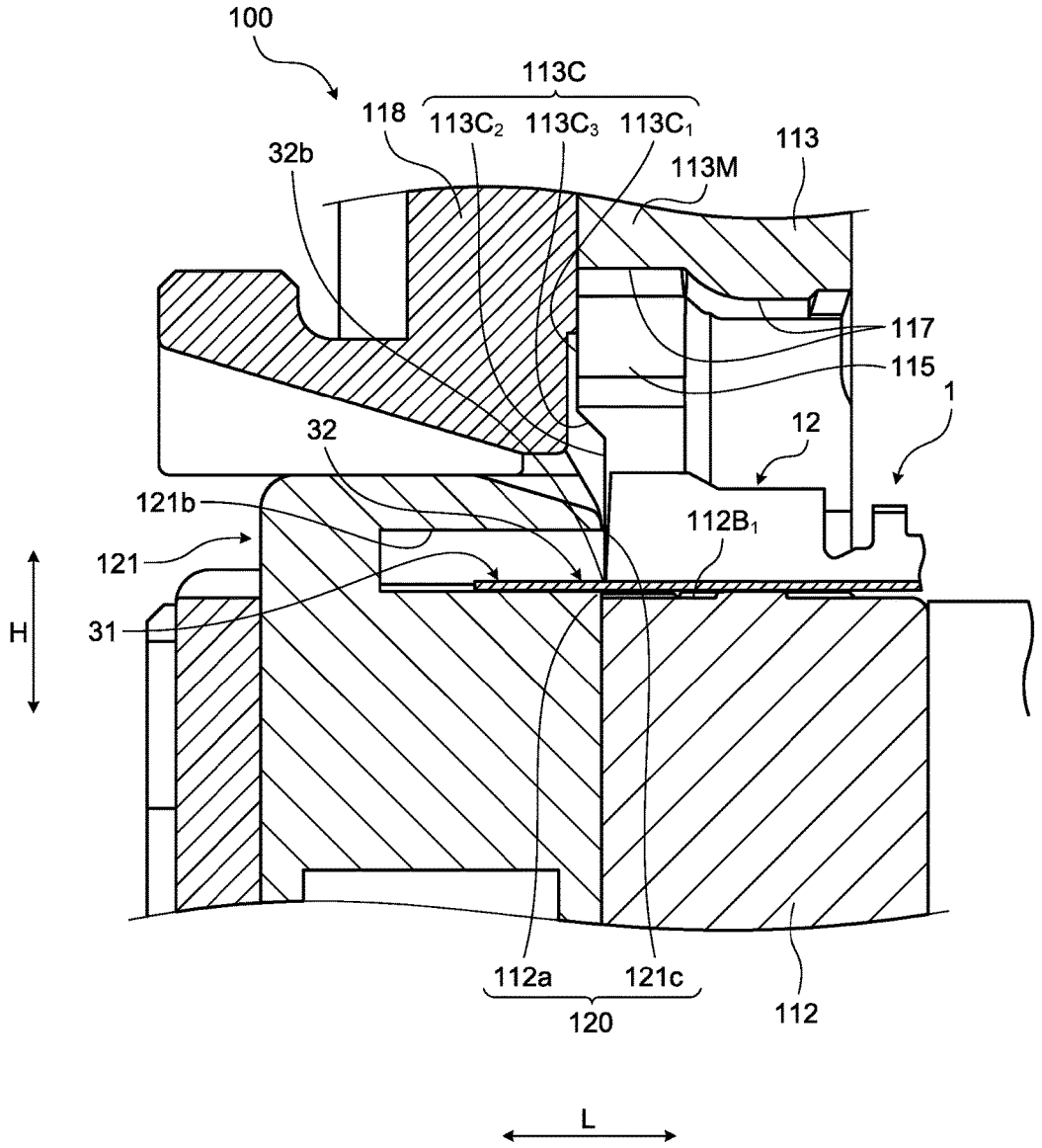
FIG. 16 is a cross-sectional view illustrating a positional relation of the terminal crimping apparatus according to the embodiment.

First, the following describes the terminal cutting mechanism 120 with reference to FIG. 16. The upper surface edge 112*a* of the first die 112 is arranged on the recessed surface 112$B_1$ serving as a supporting surface configured to support the crimp terminal 1. The upper surface edge 112*a* is an edge part arranged at an end of the recessed surface 112$B_1$ closer to the terminal cut body 121 side. The opening edge 121*c* of the terminal cut body 121 is an edge part arranged at an end of the slit 121*b* closer to the first die 112 side. The upper surface edge 112*a* and the opening edge 121*c* cut off a boundary 32*b* between the connecting part 32 and the crimp terminal 1.

To enable the boundary 32*b* to be cut off at the terminal cutting step for cutting off the connecting part 32, the terminal supply device 101 supplies the terminal chain body 30 to a position at which the boundary 32*b* of the connecting part 32 is opposed to the upper surface edge 112*a* and the opening edge 121*c* in the third direction H. That is, the crimping position according to the embodiment is a position at which the boundary 32*b* is present between the upper surface edge 112*a* and the opening edge 121*c*. The crimping position may be determined considering a stretch allowance of the electric wire connection part 12 at the crimping step. That is, as a result of the stretch of the electric wire connection part 12, the crimping position may be determined so that the position of the boundary 32*b* at the time when the terminal cutting step is executed is opposed to the opening edge 121*c*.

When the terminal cut body 121 lowers down interlocked with lowering of the second die 113 at the terminal cutting step, the opening edge 121*c* abuts on the boundary 32*b* from above. The opening edge 121*c* lowers down interlocked with lowering of the second die 113 and cuts off the boundary 32*b* together with the upper surface edge 112*a*. The opening edge 121*c* applies shearing force to the boundary 32*b* in cooperation with the upper surface edge 112*a* to cut off the boundary 32*b*.

Figure 17:
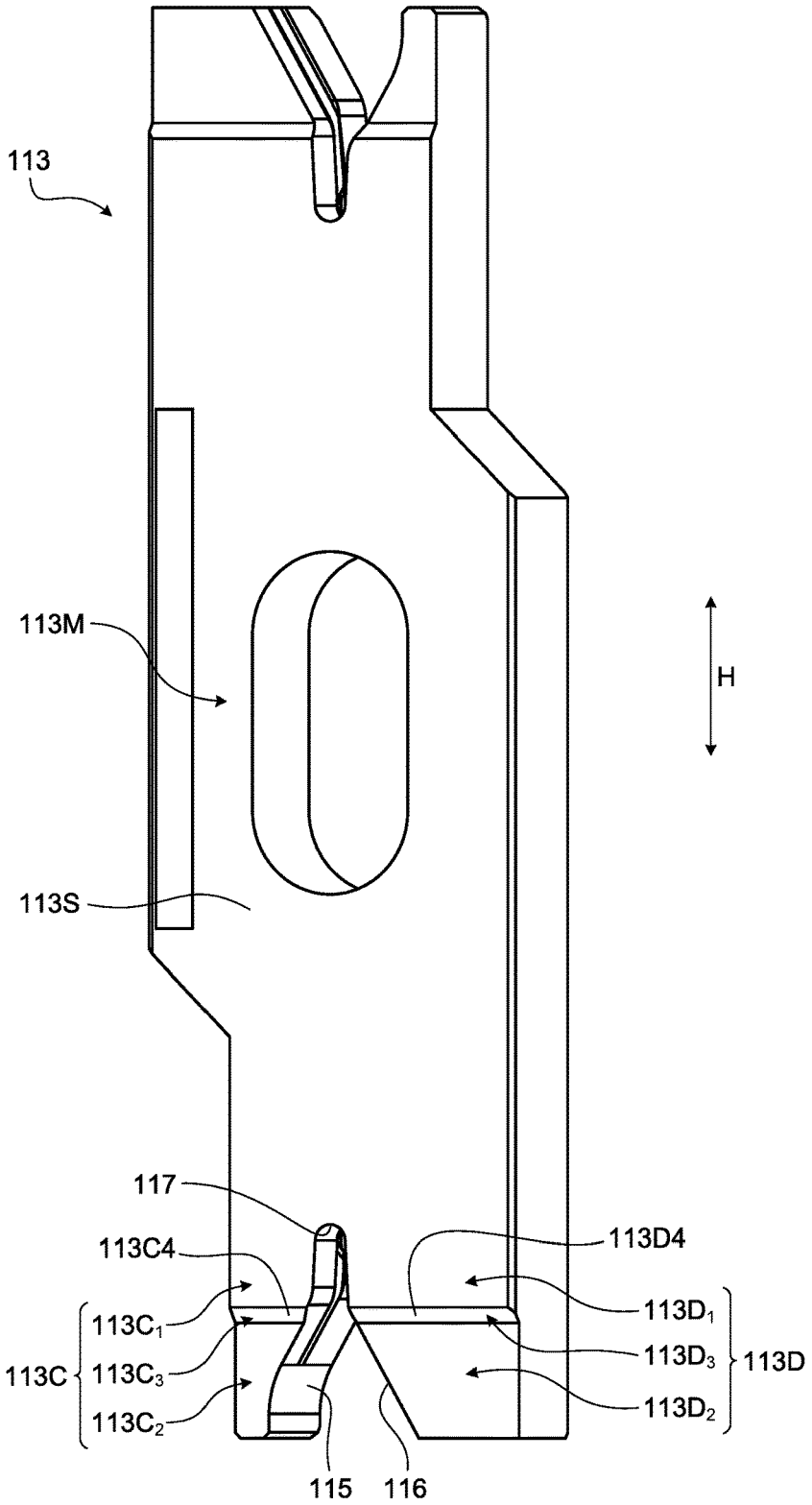
FIG. 17 is a perspective view of the second die according to the embodiment.
Figure 18:
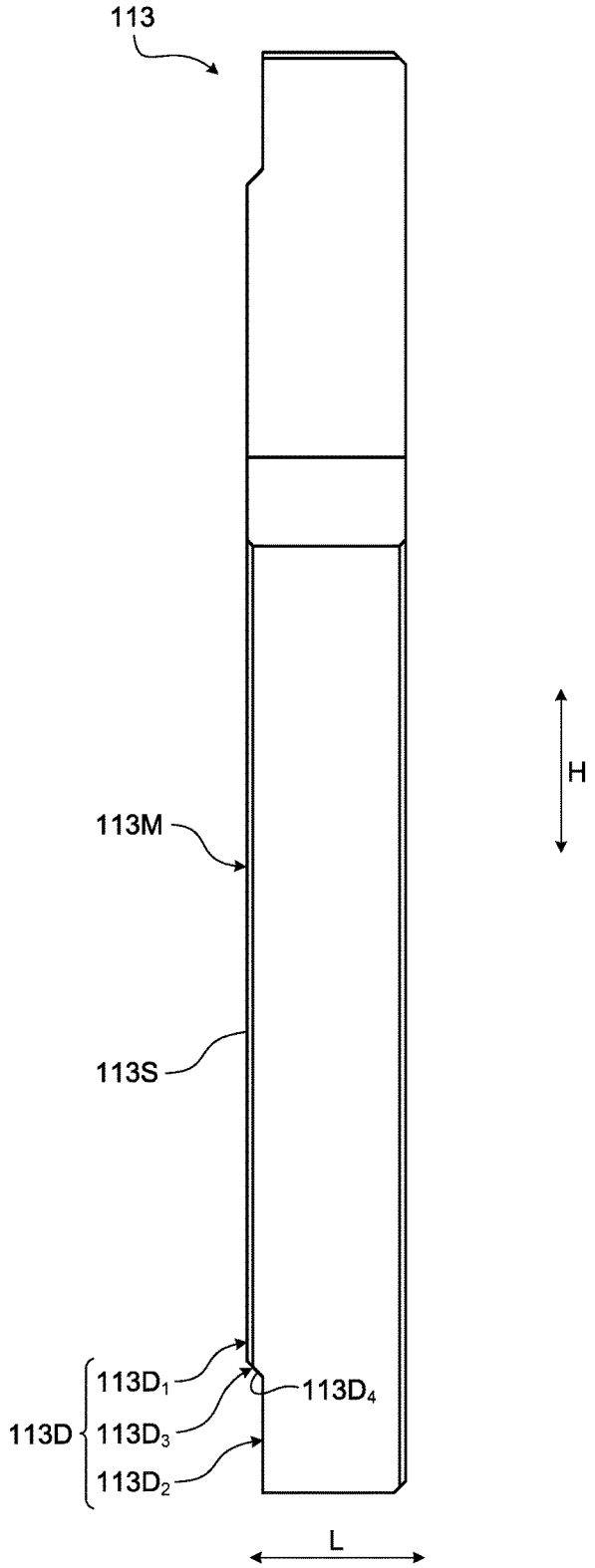
FIG. 18 is a side view of the second die according to the embodiment.
Figure 19:
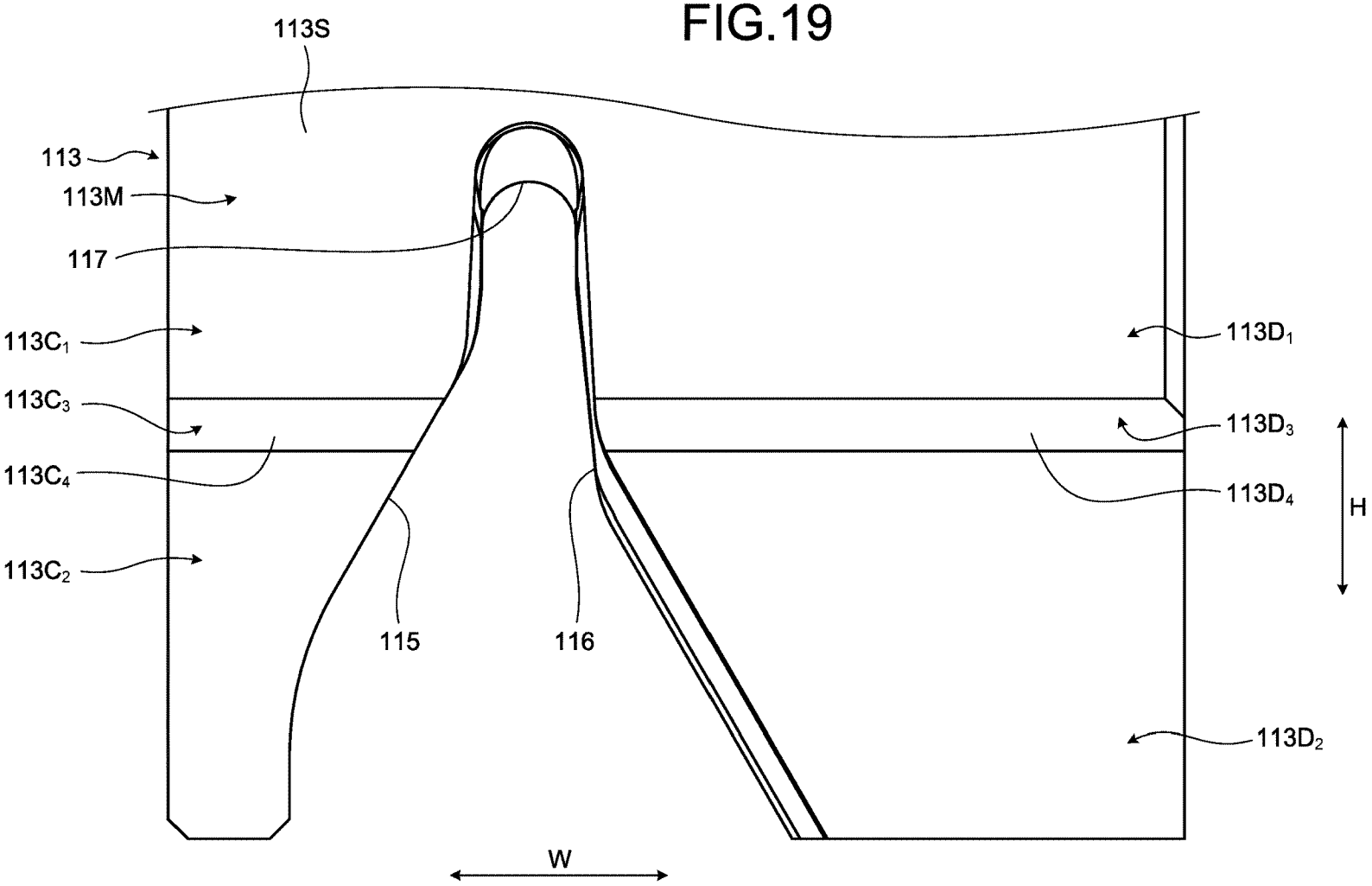
FIG. 19 is a front view of the second die according to the embodiment.

The following describes the second die 113 with reference to FIGS. 17 to 19. As illustrated in FIGS. 17 to 19, the second die 113 includes a main body 113M, a first wall part 113C, and a second wall part 113D. In this specification, the first wall part 113C and the second wall part 113D may be collectively referred to as "a pair of wall parts 113C and 113D". The main body 113M is a main body portion of the second die 113, and is a constituent part having a rectangular flat plate shape. The first wall part 113C and the second wall part 113D project from the main body 113M. In a state of being mounted on the terminal crimping apparatus 100, the first wall part 113C and the second wall part 113D project toward the first die 112, that is, project downward. As illustrated in FIG. 19, the first wall part 113C and the second wall part 113D are opposed to each other in the second direction W. That is, the pair of wall parts 113C and 113D are opposed to each other in an arrangement direction of the crimp terminal 1 in the terminal chain body 30. As described above with reference to FIG. 10, the pair of wall parts 113C and 113D is brought into contact with the electric wire connection part 12 of the crimp terminal 1 at the crimping step to bend the electric wire connection part 12.

The pair of wall parts 113C and 113D respectively includes base end parts 113$C_1$ and 113$D_1$, and hem parts 113$C_2$ and 113$D_2$. The base end parts 113$C_1$ and 113$D_1$ are portions of the pair of wall parts 113C and 113D closer to the main body 113M side. The hem parts 113$C_2$ and 113$D_2$ are portions of the pair of wall parts 113C and 113D closer to the distal end than the base end parts 113$C_1$ and 113$D_1$. Plate thicknesses of the hem parts 113$C_2$ and 113$D_2$ are thinner than those of the base end parts 113$C_1$ and 113$D_1$. In accordance with variation in the plate thickness, a level difference is formed from the base end parts 113$C_1$ and 113$D_1$ toward the hem parts 113$C_2$ and 113$D_2$ on a front surface 113S of the second die 113. The front surface 113S is a surface on the terminal cut body 121 side.

More specifically, in the pair of wall parts 113C and 113D, intermediate parts 113$C_3$ and 113$D_3$ are arranged for connecting the base end parts 113$C_1$ and 113$D_1$ with the hem parts 113$C_2$ and 113$D_2$. The plate thicknesses of the intermediate parts 113$C_3$ and 113$D_3$ are reduced from the base end parts 113$C_1$ and 113$D_1$ toward the hem parts 113$C_2$ and 113$D_2$. In accordance with variation in the plate thickness, portions of the front surface 113S corresponding to the intermediate parts 113$C_3$ and 113$D_3$ are inclined surfaces $113C_4$ and $113D_4$. The inclined surfaces $113C_4$ and $113D_4$ are inclined obliquely downward.

With reference to FIG. 16, the following describes a positional relation in the first direction L among parts of the terminal crimping apparatus 100 according to the embodiment. As illustrated in FIG. 16, the position of the boundary 32*b* of the connecting part 32 in the first direction L is the same as the position of the upper surface edge 112*a*. Thus, the upper surface edge 112*a* is brought into contact with the boundary 32*b* from below at the terminal cutting step. The position of the opening edge 121*c* in the first direction L is the same as the position of the boundary 32*b* of the connecting part 32, or a position slightly closer to the coupling piece 31 than the boundary 32*b*. The opening edge 121*c* is brought into contact with the boundary 32*b* from above at the terminal cutting step.

The following describes a positional relation among the parts of the second die 113 and the parts of the first die 112 and the terminal cut body 121. FIG. 16 illustrates a positional relation between the first wall part 113C of the pair of wall parts 113C and 113D and the first die 112 or the terminal cut body 121. The second wall part 113D also has the same positional relation as that of the first wall part 113C.

The main body 113M of the second die 113 and the base end part $113C_1$ of the first wall part 113C project toward the terminal cut body 121 from the upper surface edge 112*a*. That is, the main body 113M and the base end part $113C_1$ project toward the terminal cut body 121 from a range in which the recessed surface $112B_1$ is present. In other words, the third wall surface 117 and the first wall surface 115 of the base end part $113C_1$ project toward the terminal cut body 121 from the upper surface edge 112*a*.

The main body 113M and the base end part $113C_1$ may project, for example, toward the terminal cut body 121 at least to a position of the opening edge 121*c*. Alternatively, the main body 113M and the base end part $113C_1$ may project toward the terminal cut body 121 across the position of the opening edge 121*c*. In the embodiment, as illustrated in FIG. 16, the main body 113M and the base end part $113C_1$ project toward the terminal cut body 121 across the position of the opening edge 121*c*.

A projecting amount toward the terminal cut body 121 is, for example, determined in accordance with a stretching amount of the crimp terminal 1 at the crimping step. The terminal crimping apparatus 100 according to the embodiment executes the terminal cutting step in parallel with the crimping step. Even when the connecting part 32 is cut off at the terminal cutting step, the terminal crimping apparatus 100 crimps the electric wire connection part 12 onto the electric wire 50. The electric wire connection part 12 stretches along the first direction L even after the terminal cutting step is completed, so that it can be considered that the end of the electric wire connection part 12 projects toward the terminal cut body 121 from the recessed surface $112E_1$. In a case in which the connecting part 32 is cut off at the boundary 32*b* between itself and the electric wire connection part 12 as described in the embodiment, it can be considered that the electric wire connection part 12 tends to protrude toward the terminal cut body 121 from the recessed surface $112B_1$. If the second die 113 cannot cope with the stretch of the electric wire connection part 12, a swaging residue may be caused in the electric wire connection part 12.

On the other hand, in the second die 113 according to the embodiment, the main body 113M and the base end part $113C_1$ project toward the terminal cut body 121 from the upper surface edge 112*a*. Although not illustrated in FIG. 16, the base end part $113D_1$ of the second wall part 113D also projects toward the terminal cut body 121 from the upper surface edge 112*a* similarly to the base end part $113C_1$. Accordingly, even when the electric wire connection part 12 protrudes from the recessed surface $112B_1$ toward the terminal cut body 121 at the crimping step, the protruding portion is crimped onto the electric wire 50 by the second die 113. Due to this, a swaging residue in the electric wire connection part 12 can be eliminated.

As illustrated in FIG. 16, the hem part $113C_2$ of the second die 113 is positioned closer to the first die 112 than the upper surface edge 112*a*. In other words, the hem part $113C_2$ does not project toward the terminal cut body 121 across the upper surface edge 112*a*. Similarly, the hem part $113D_2$ of the second wall part 113D is positioned closer to the first die 112 than the upper surface edge 112*a*. The hem parts $113C_2$ and $113D_2$ of the second die 113 are closer to the first die 112 than the upper surface edge 112*a*, so that interference between the second die 113 and the terminal cut body 121 are prevented.

A range in which the hem parts $113C_2$ and $113D_2$ are arranged is defined so that the terminal cut body 121 and the second die 113 do not interfere with each other even when the terminal cut body 121 and the second die 113 move relatively to each other. In the terminal crimping apparatus 100 according to the embodiment, the terminal cut body 121 is kept stopping at an initial stage at which the second die 113 starts to lower down, and the second die 113 moves downward relatively to the terminal cut body 121. When a lowering distance of the second die 113 is equal to or larger than a predetermined distance, the terminal cut body 121 starts to lower down interlocked with lowering of the second die 113. The hem parts $113C_2$ and $113D_2$ are arranged in a range corresponding to a distance of movement of the second die 113 relative to the terminal cut body 121 at an initial stage of lowering. That is, an installation range of the hem parts $113C_2$ and $113D_2$ is defined so that the second die 113 does not collide with the terminal cut body 121 in a period in which the second die 113 moves relatively to the terminal cut body 121.

In this way, the terminal crimping apparatus 100 according to the embodiment can cut off the boundary 32*b* of the connecting part 32, and can eliminate the swaging residue of the electric wire connection part 12 while preventing interference between the second die 113 and the terminal cut body 121.

Figure 20:
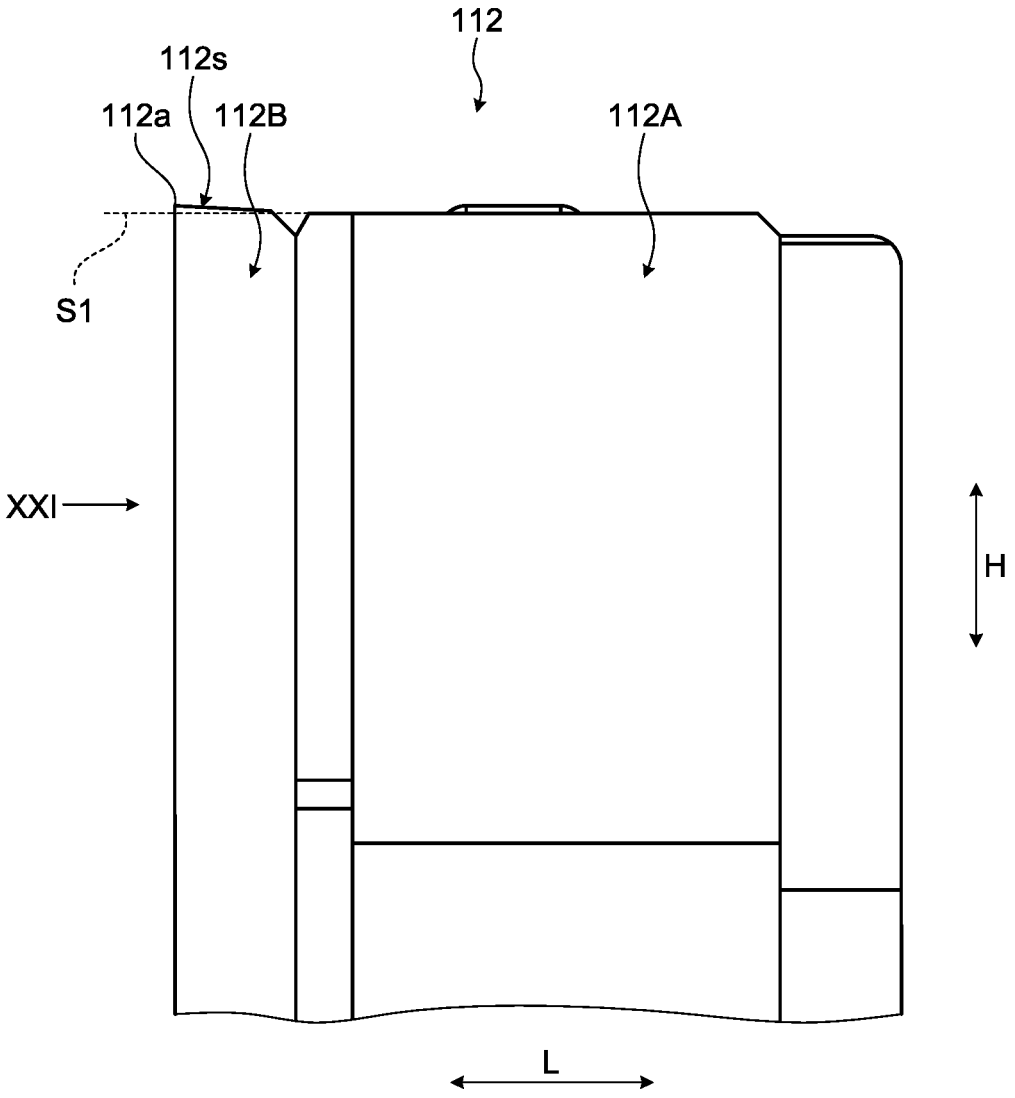
FIG. 20 is a side view of the first die according to the embodiment.

Additionally, in the terminal crimping apparatus 100 according to the embodiment, as described below, the first die 112 is configured to be able to prevent interference between the terminal accommodating part and the crimp terminal 1 after swaging. As illustrated in FIG. 20, the first die 112 according to the embodiment includes an inclined part 112*s* inclined with respect to the first direction L. The inclined part 112*s* is inclined upward as coming closer to the upper surface edge 112*a* along the first direction L. The inclined part 112*s* according to the embodiment is formed in the second anvil 112B. As illustrated in FIG. 20, an upper end of the second anvil 112B is inclined with respect to a virtual plane S1 illustrated by a dashed line. The virtual plane S1 is a plane parallel with the first direction L and orthogonal to the third direction H. On the other hand, the upper end of the first anvil 112A extends along the virtual plane S1, and is not inclined with respect to the virtual plane S1.

Figure 21:
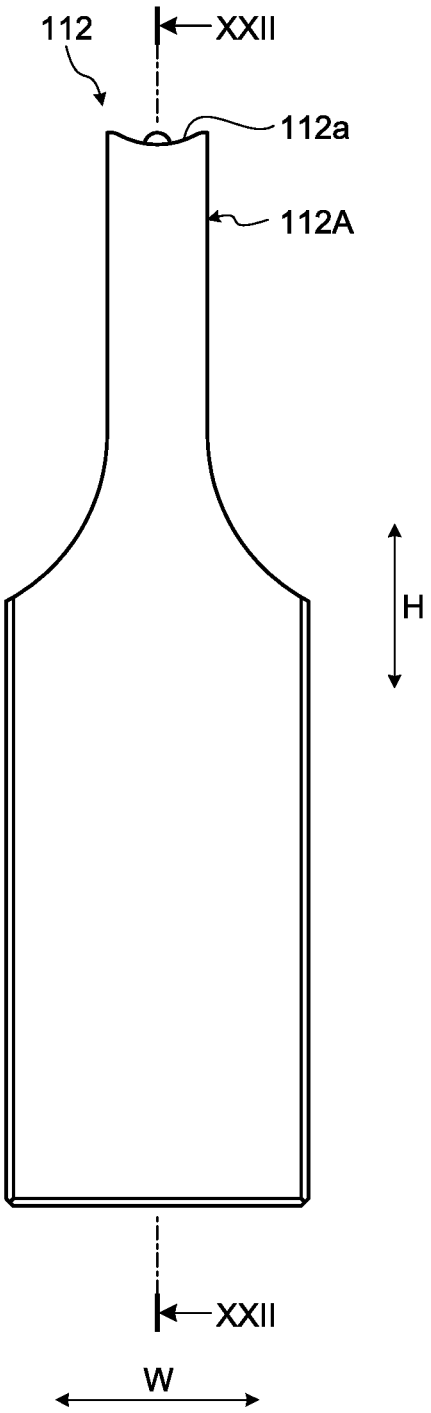
FIG. 21 is a front view of the first die according to the embodiment.
Figure 22:
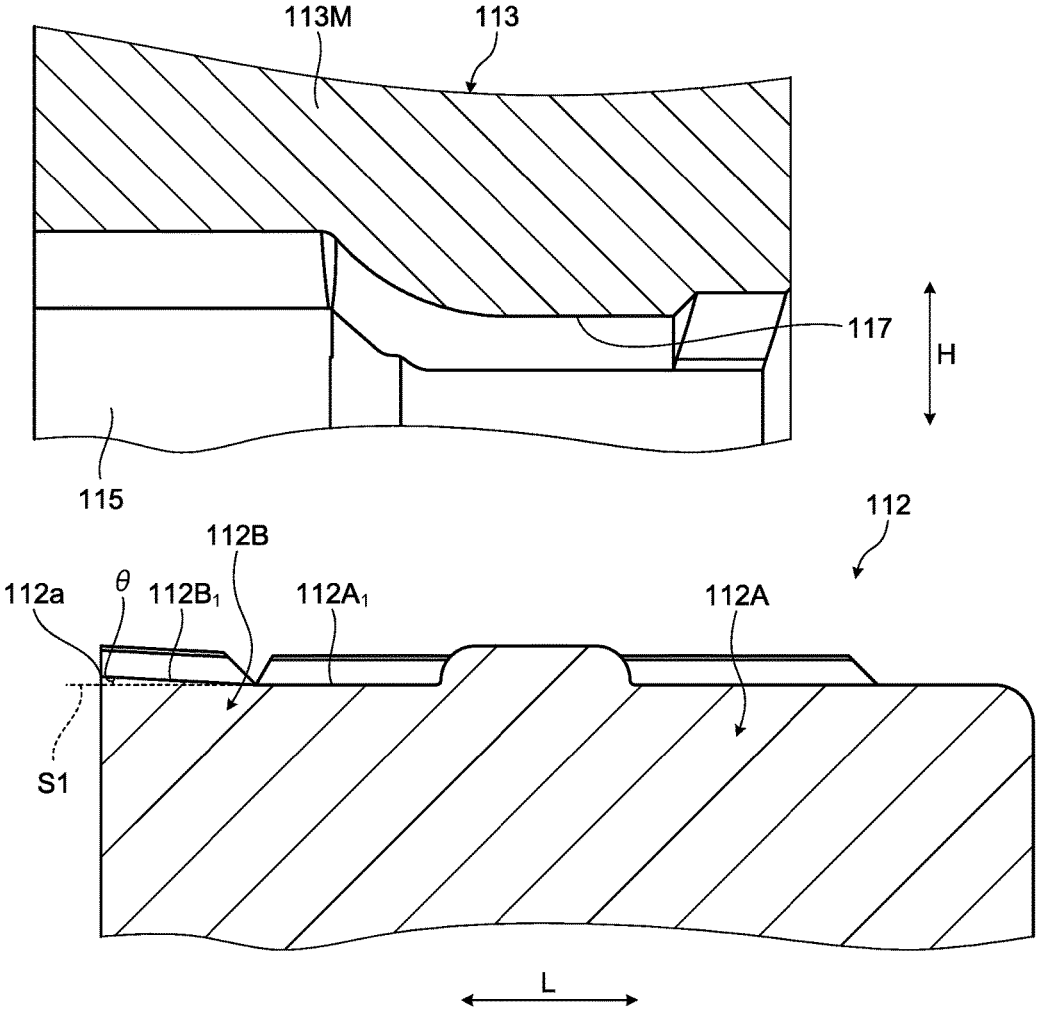
FIG. 22 is a cross-sectional view of the first die and the second die according to the embodiment.

FIG. 21 illustrates a front view of the second anvil 112B. FIG. 21 is a view along the arrow XXI of FIG. 20. FIG. 22 illustrates a cross section along XXII-XXII of FIG. 21. As illustrated in FIG. 22, the recessed surface 112$B_1$ of the second anvil 112B is inclined with respect to the virtual plane S1. The recessed surface 112$B_1$ is inclined toward the second die 113 as coming closer to the upper surface edge 112*a* along the first direction L. On the other hand, the recessed surface 112$A_1$ of the first anvil 112A extends along the virtual plane S1. That is, in the cross section illustrated in FIG. 22, in other words, the cross section orthogonal to the second direction W, the recessed surface 112$B_1$ is inclined with respect to the first direction L, and the recessed surface 112$A_1$ is parallel with the first direction L. In the following description, the cross section orthogonal to the second direction W is referred to as a "vertical section". The vertical section is a cross section in parallel with each of the first direction L and the third direction H.

The following further describes the recessed surface 112$B_1$ according to the embodiment. The shape of the recessed surface 112$B_1$ in the vertical section is a straight line having a fixed inclination angle θ with respect to the first direction L. The recessed surface 112$B_1$ is arranged from one end to the other end of the second anvil 112B in the first direction L. That is, the entire recessed surface 112$B_1$ is inclined with respect to the first direction L.

Figure 23:
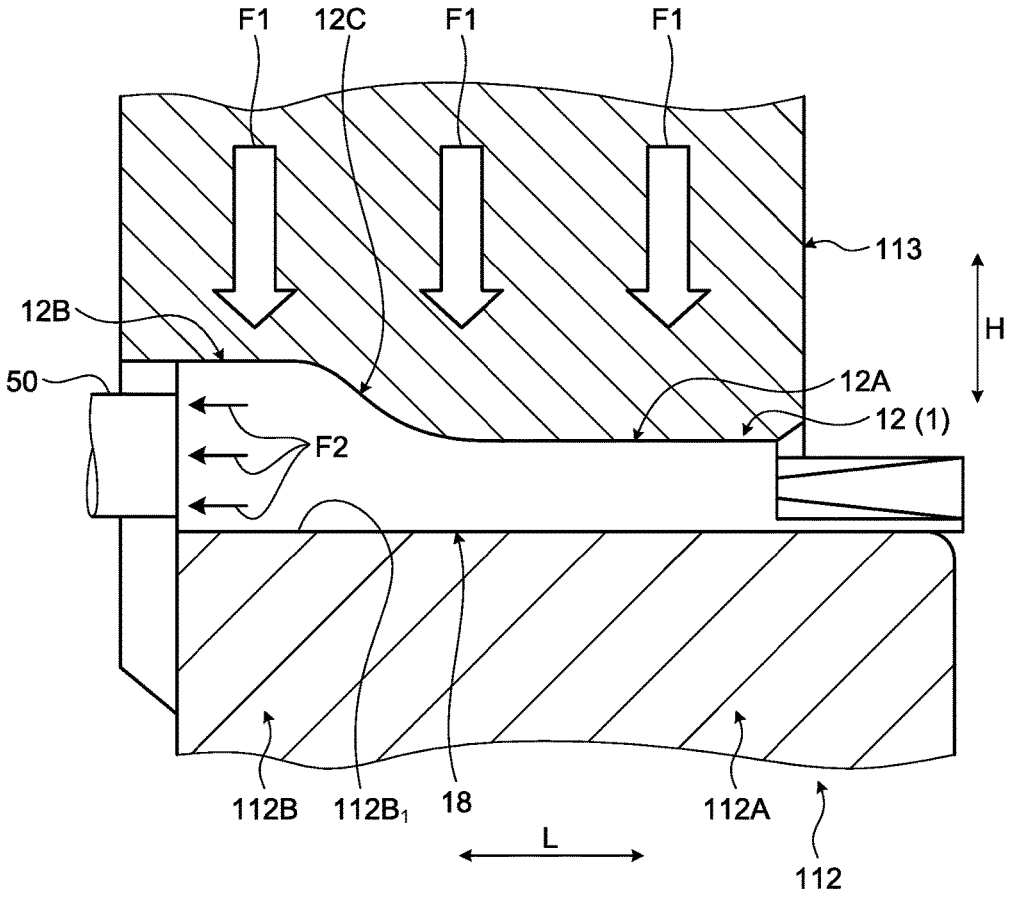
FIG. 23 is a diagram illustrating a state immediately after a terminal cutting step.
Figure 24:
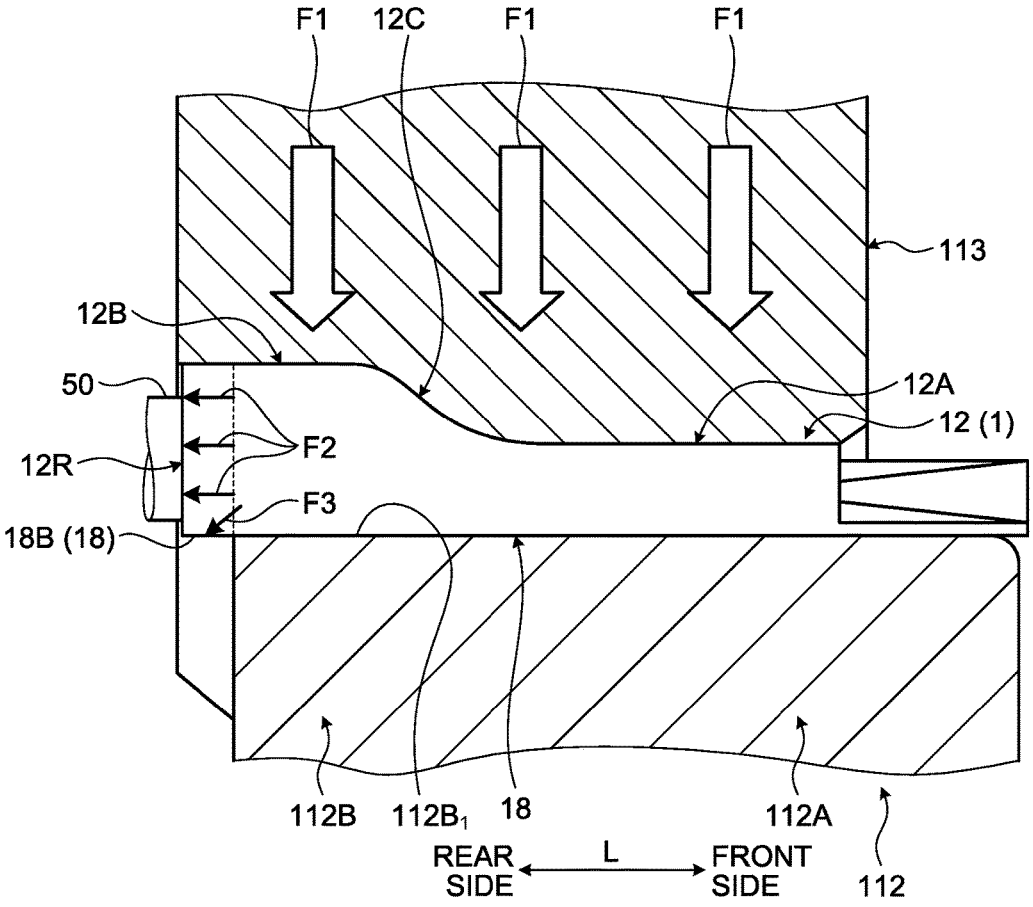
FIG. 24 is a diagram illustrating a state in which a rear end of an electric wire connection part protrudes.

The recessed surface 112$B_1$ is thus inclined with respect to the first direction L, so that an undesired projecting part is hardly generated in the crimp terminal 1 as described below. FIG. 23 illustrates the crimp terminal 1, the first die 112, and the second die 113 immediately after the terminal cutting step is executed. After the connecting part 32 is cut off from the crimp terminal 1 at the terminal cutting step, the electric wire connection part 12 is pressed against the first die 112 by the second die 113. Due to pressing force F1 applied from the second die 113, force F2 of stretching along the first direction L is generated in the electric wire connection part 12. When the electric wire connection part 12 is stretched by the force F2, a rear end part 12R of the electric wire connection part 12 protrudes from the first die 112 as illustrated in FIG. 24.

In the crimp terminal 1, a "front side" means the core wire crimping part 12A side viewed from the coupling crimping part 12C in an axial direction of the crimp terminal 1. On the other hand, a "rear side" of the crimp terminal 1 means the coating crimping part 12B side viewed from the coupling crimping part 12C in the axial direction of the crimp terminal 1. That is, the rear side of the crimp terminal 1 is a side connected to the connecting part 32 in the first direction L. The front and rear direction in this specification is a convenient explanation for description, and is not necessarily identical to a direction in a state in which the crimp terminal 1 is mounted on a vehicle and the like. For example, the crimp terminal 1 is used in a posture such that the axial direction is the vertical direction in some cases.

Figure 29:
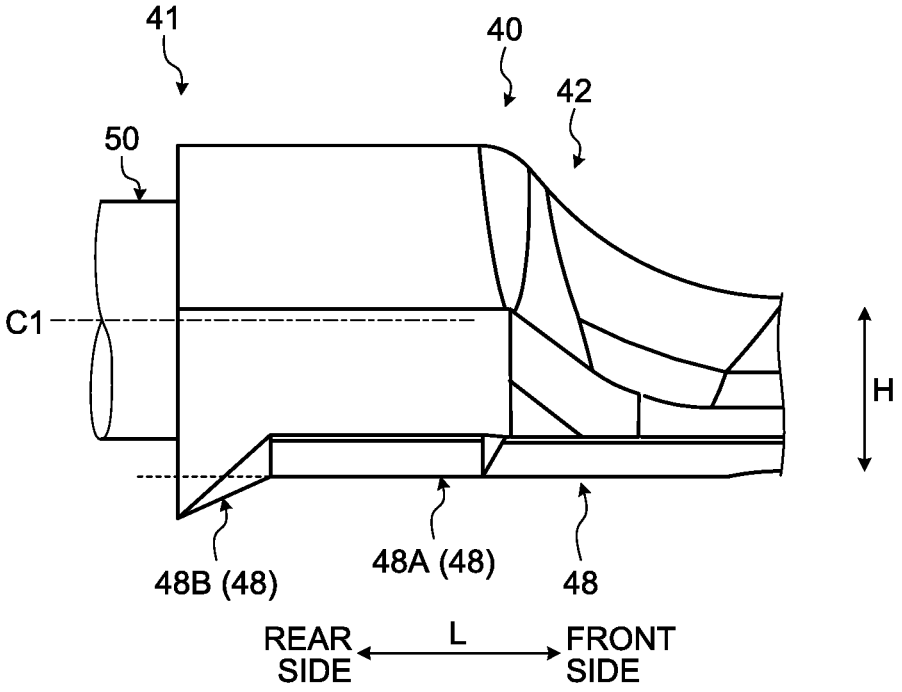
FIG. 29 is a side view illustrating a rear end part of an electric wire with a terminal of a comparative example.

Not only the force F2 in a stretching direction but also downward force F3 are applied to the electric wire connection part 12. When the downward force F3 is applied to the rear end part 12R that is not supported by the recessed surface 112$B_1$, the rear end part 12R tends to be undesirably deformed. Specifically, a projecting part 48B as illustrated in FIG. 29 tends to be generated at the rear end part of the electric wire connection part. FIG. 29 illustrates an electric wire 41 with a terminal according to a comparative example. In the electric wire 41 with a terminal according to the comparative example, the crimp terminal 40 is crimped onto the electric wire 50 using the first die not including the inclined part 112*s*. In other words, an electric wire connection part 42 of the crimp terminal 40 is swaged by the first die the recessed surface of which is in parallel with the first direction L.

As illustrated in FIG. 29, the projecting part 48B is formed at a rear end of the electric wire connection part 42. The projecting part 48B is a rear end part of a bottom face 48 of the electric wire connection part 42. The projecting part 48B projects downward from an extension line of a front portion 48A of the bottom face 48. The projecting part 48B is an inclined surface that becomes more distant from a center axis C1 of the electric wire connection part 42 as coming closer to the rear end. The projecting part 48B easily interferes with a wall part of the terminal accommodating part when the crimp terminal 40 is accommodated in the terminal accommodating part, and may cause the crimp terminal 40 to be hardly accommodated.

Figure 25:
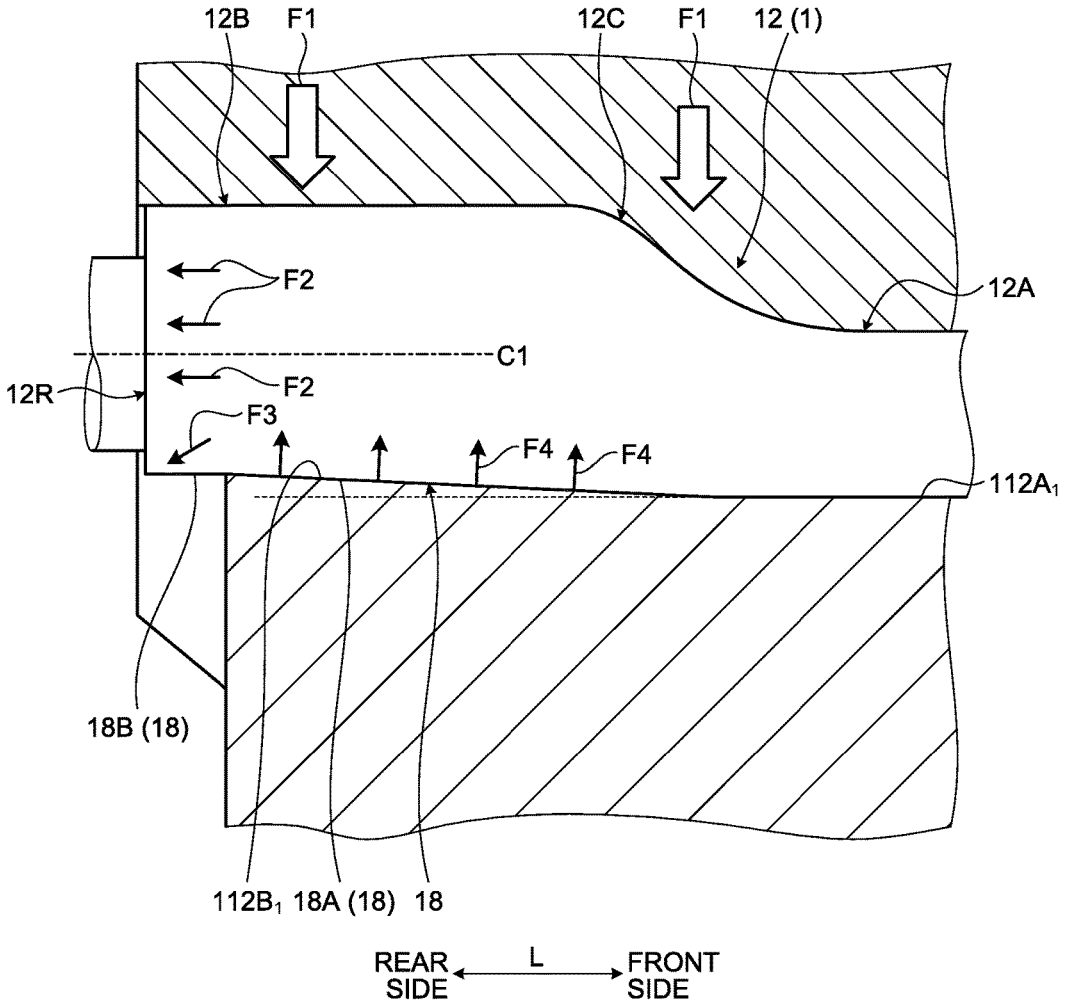
FIG. 25 is a diagram for explaining deformation of the electric wire connection part according to the embodiment.

On the other hand, the electric wire 2 with a terminal according to the embodiment prevents the protruding part from being generated. As illustrated in FIG. 25, force F4 of causing a bottom face 18 to be recessed toward the center axis C1 is applied to the electric wire connection part 12. The force F4 is reaction force applied to the bottom face 18 from the recessed surface 112$B_1$. The bottom face 18 is bent so that a portion 18A supported by the recessed surface 112$B_1$ is inclined with respect to the first direction L. In the following description, the portion 18A supported by the recessed surface 112$B_1$ is referred to as a "supported part 18A". The supported part 18A is inclined by the force F4 so as to come closer to the center axis C1 toward the rear side.

Figure 26:
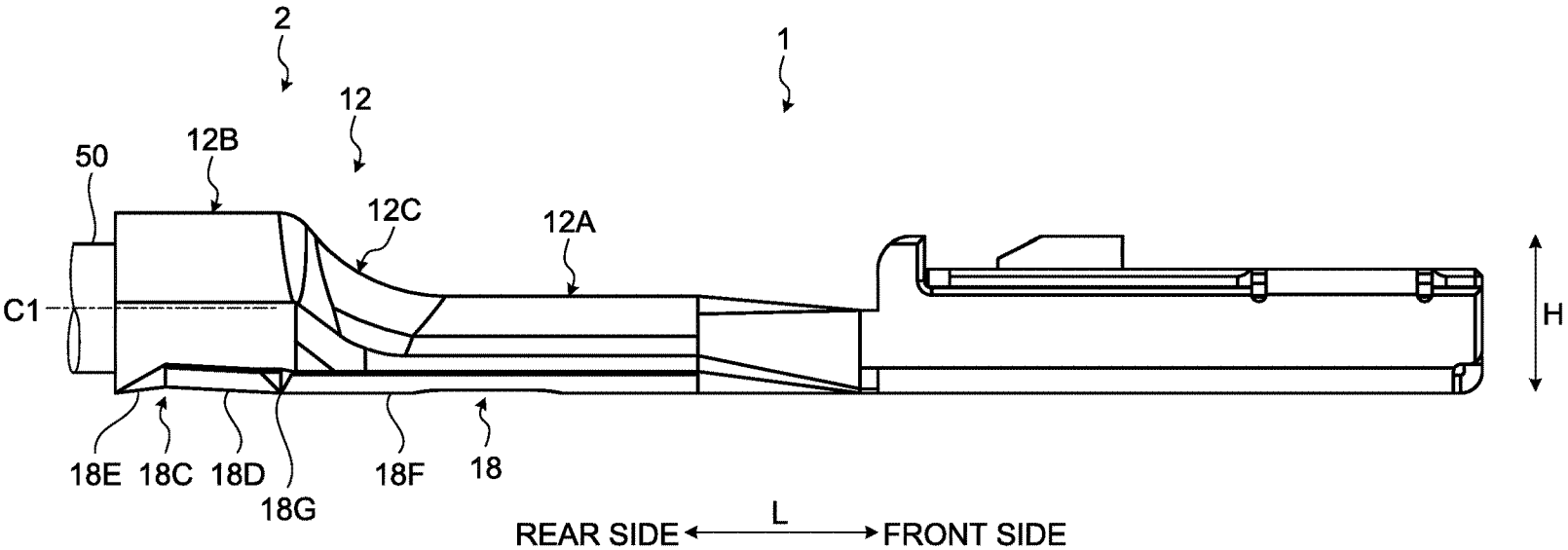
FIG. 26 is a side view illustrating an electric wire with a terminal according to the embodiment.
Figure 27:
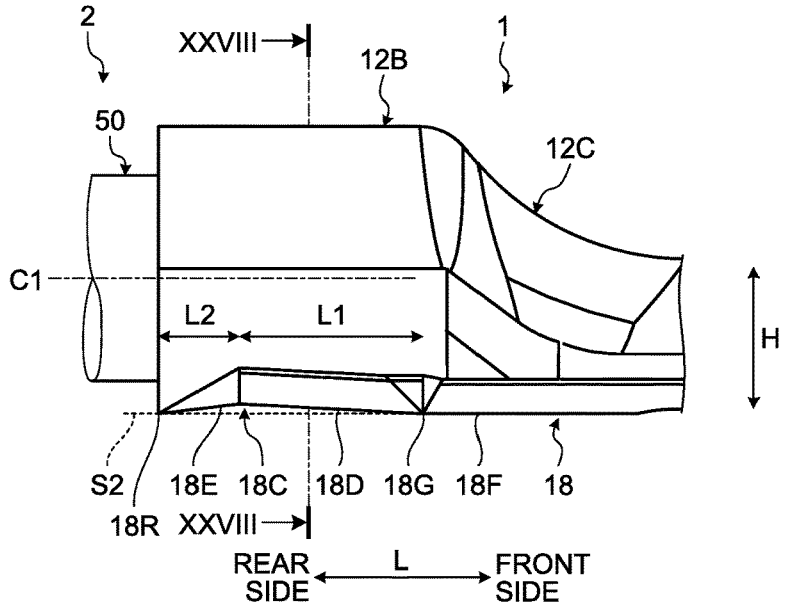
FIG. 27 is a side view illustrating a rear end part of the electric wire with a terminal according to the embodiment.

A portion 18B (hereinafter, simply referred to as a "rear end part 18B") corresponding to the rear end part 12R of the bottom face 18 is deformed downward by the downward force F3. Due to deformation of inclining the supported part 18A and deformation of the rear end part 18B of the bottom face 18, a recessed part 18C illustrated in FIG. 26 is formed on the electric wire connection part 12 after crimping. The recessed part 18C is a rear end part of the bottom face 18. The recessed part 18C is recessed toward the center axis C1 of the electric wire connection part 12. More specifically, as illustrated in FIGS. 26 and 27, the recessed part 18C includes a first inclined surface 18D and a second inclined surface 18E. The first inclined surface 18D is a portion on the front side of the recessed part 18C. The first inclined surface 18D is an inclined surface that comes closer to the center axis C1 toward the rear side. The second inclined surface 18E is a portion on the rear side of the recessed part 18C. The second inclined surface 18E is an inclined surface that becomes more distant from the center axis C1 toward the rear side.

A bent part 18G is formed on the bottom face 18 in accordance with formation of the first inclined surface 18D. The bent part 18G is a portion bent toward a side for causing the rear end 18R of the bottom face 18 to be closer to the center axis C1. The bottom face 18 is bent at the bent part 18G in a projecting shape projecting toward a side away from the center axis C1. A bent line of the bent part 18G extends in the second direction W. That is, the bottom face 18 is bent along the bent line extending in the second direction W.

Figure 28:
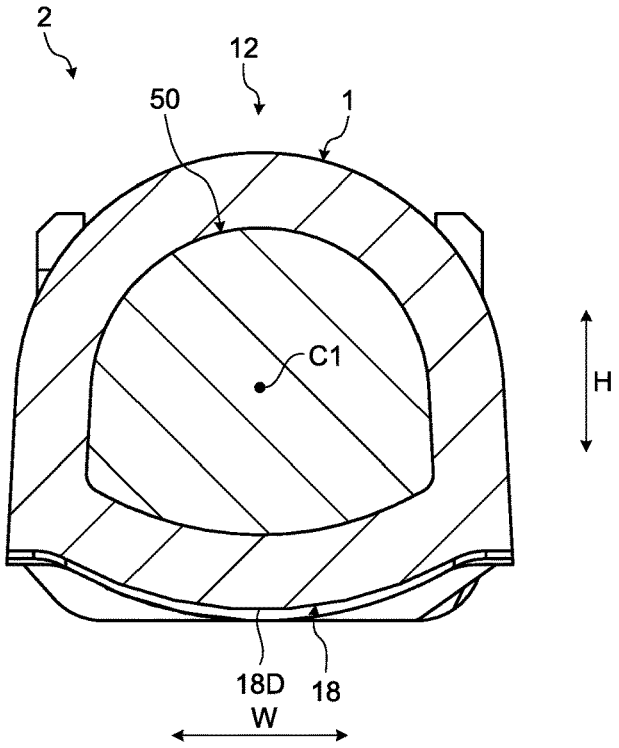
FIG. 28 is a cross-sectional view of a first inclined surface of the electric wire with a terminal according to the embodiment.

FIG. 28 illustrates a cross-sectional shape of the first inclined surface 18D. FIG. 28 is a cross-sectional view along XXVIII-XXVIII of FIG. 27, and is a cross-sectional view orthogonal to the first direction L. In the following description, a cross section orthogonal to the first direction L is referred to as a "transverse section". The transverse section is also orthogonal to the center axis C1 of the electric wire connection part 12. The cross-sectional shape of the first inclined surface 18D is a curved shape curved outward as illustrated in FIG. 28. In other words, the cross-sectional shape of the first inclined surface 18D on the transverse section is curved toward a direction away from the center axis C1. The cross-sectional shape of the first inclined surface 18D corresponds to the cross-sectional shape of the recessed surface 112$B_1$. That is, the shape of the recessed surface 112$B_1$ is transferred to the bottom face 18 at the crimping step. The cross-sectional shape of the second inclined surface 18E on the transverse section is a shape curved toward a direction away from the center axis C1, which is similar to the cross-sectional shape of the first inclined surface 18D. That is, in the recessed part 18C according to the embodiment, two projecting surfaces having a curved cross-sectional shape are connected to each other.

The crimping device 102 according to the embodiment can crimp the crimp terminal 1 onto the electric wire 50 so that the second inclined surface 18E does not project from a virtual plane S2 (FIG. 27) after crimping. As illustrated in FIG. 27, when the crimp terminal 1 after crimping is viewed from a side, the rear end 18R of the bottom face 18 is substantially positioned on the virtual plane S2. The virtual plane S2 is a plane to be in contact with a portion 18F on a front side of the recessed part 18C of the bottom face 18. The virtual plane S2 is a plane orthogonal to the third direction H, and being in contact with a lower end of the portion 18F on the front side. That is, when the crimp terminal 1 is viewed from the side, the rear end 18R of the bottom face 18 is positioned on an extension line of the lower end of the portion 18F on the front side, or positioned substantially on the extension line. Thus, in the electric wire 2 with a terminal according to the embodiment, the projecting part 48B in the electric wire 41 with a terminal according to the comparative example is hardly formed. Accordingly, in the electric wire 2 with a terminal according to the embodiment, interference between the electric wire connection part 12 and the terminal accommodating part is hardly caused when the crimp terminal 1 is accommodated in the terminal accommodating part.

The crimping device 102 may bend the bottom face 18 so that the rear end 18R is positioned closer to the center axis C1 than the virtual plane S2 after crimping. The position of the rear end 18R after crimping is, for example, adjusted with a position at which the bent part 18G is formed or the inclination angle θ.

In the electric wire 2 with a terminal according to the embodiment, the recessed part 18C is formed on the bottom face 18 of the coating crimping part 12B. More specifically, the recessed part 18C is formed in a range from the front end to the rear end of the coating crimping part 12B. In other words, the recessed part 18C is formed in substantially the entire range of the coating crimping part 12B along the first direction L. The bent part 18G is formed at the front end part of the coating crimping part 12B.

The recessed part 18C is formed in the coating crimping part 12B, so that the shapes of the core wire crimping part 12A and the coupling crimping part 12C are hardly influenced by formation of the recessed part 18C. For example, influence of deteriorating crimping strength or a resistance value between the core wire 51 and the core wire crimping part 12A is hardly caused on the shape of the core wire crimping part 12A or the coupling crimping part 12C. Accordingly, the electric wire 2 with a terminal according to the embodiment can prevent interference between the electric wire connection part 12 and the terminal accommodating part while keeping strength and an electrical characteristic.

In the recessed part 18C according to the embodiment, the first inclined surface 18D is longer than the second inclined surface 18E. As illustrated in FIG. 27, a length L1 of the first inclined surface 18D in the first direction L is longer than a length L2 of the second inclined surface 18E in the first direction L. Due to the long length L1 of the first inclined surface 18D, an abrupt change in the shape of the bottom face 18 is hardly caused. For example, a bending angle (bending amount) of the bent part 18G hardly becomes large. Additionally, bending at a boundary part between the first inclined surface 18D and the second inclined surface 18E tends to be gentle. Abrupt undulations are hardly generated on the bottom face 18, so that local concentration of stress or local thinning of the bottom face 18 is prevented.

As described above, the electric wire 2 with a terminal according to the embodiment includes the electric wire 50, and the crimp terminal 1 including the terminal connection part 11 and the electric wire connection part 12. The terminal connection part 11 is a portion electrically connected to a counterpart terminal. The terminal connection part 11 is positioned on the front side in the connecting direction for being connected with the counterpart terminal. The electric wire connection part 12 is a portion wound around and crimped onto the electric wire 50. The electric wire connection part 12 is positioned on the rear side in the connecting direction for being connected with the counterpart terminal.

On the bottom face 18 of the electric wire connection part 12, formed is the bent part 18G that is bent toward a side for causing the rear end 18R of the bottom face 18 to be closer to the center axis C1 of the electric wire connection part 12. When the bent part 18G is formed, a portion projecting from the virtual plane S2 is hardly generated on the bottom face 18 of the electric wire connection part 12 after crimping. More specifically, the second inclined surface 18E formed by deforming the rear end part 18B is prevented from projecting from the virtual plane S2. When the first inclined surface 18D is formed by the recessed surface 112$B_1$ of the second anvil 112B, the second inclined surface 18E entirely moves toward the center axis C1. As a result, the rear end 18R comes closer to the center axis C1, and a maximum height of the electric wire connection part 12 is reduced. A portion projecting from other portions toward the third direction H is hardly generated on the bottom face 18, so that interference between the terminal accommodating part and the electric wire connection part 12 is prevented.

In the electric wire 2 with a terminal according to the embodiment, a portion on the rear side of the bent part 18G on the bottom face 18 is the recessed part 18C that is recessed toward the center axis C1. The portion on the front side of the recessed part 18C is the first inclined surface 18D that comes closer to the center axis C1 toward the rear side, and the portion on the rear side of the recessed part 18C is the second inclined surface 18E that becomes more distant from the center axis C1 toward the rear side. The recessed part 18C including the two inclined surfaces 18D and 18E is formed in the electric wire connection part 12, so that interference between the terminal accommodating part and the electric wire connection part 12 is prevented.

In the electric wire 2 with a terminal according to the embodiment, when the crimp terminal 1 is viewed from the side, the rear end 18R of the bottom face 18 is positioned on an extension line of the portion 18F on the front side of the recessed part 18C on the bottom face 18, or positioned closer to the center axis C1 than the extension line. Due to such a shape of the crimp terminal 1 after crimping, interference between the terminal accommodating part and the electric wire connection part 12 are more securely prevented.

The recessed part 18C according to the embodiment is formed on the bottom face 18 of the coating crimping part 12B. Accordingly, the coupling crimping part 12C and the core wire crimping part 12A are hardly influenced by formation of the recessed part 18C.

The terminal crimping apparatus 100 according to the embodiment includes the terminal supply device 101, the first die 112, the second die 113, and the terminal cut body 121. The terminal supply device 101 is a device configured to supply the terminal chain body 30. The terminal chain body 30 includes a plurality of crimp terminals 1 arranged in parallel, the coupling piece 31 extending along the arrangement direction of the crimp terminals 1, and the connecting part 32 connecting one end of the crimp terminal 1 with the coupling piece 31.

The first die 112 includes the recessed surfaces 112$A_1$ and 112$B_1$ serving as supporting surfaces, and the upper surface edge 112*a* serving as a first edge part. The recessed surfaces 112$A_1$ and 112$B_1$ support the crimp terminal 1 supplied by the terminal supply device 101. The upper surface edge 112*a* is an edge part arranged at one end of the recessed surfaces 112$A_1$ and 112$B_1$.

The second die 113 is arranged to be opposed to the recessed surfaces 112$A_1$ and 112$B_1$. The second die 113 sandwiches the crimp terminal 1 and the electric wire 50 between itself and the recessed surfaces 112$A_1$ and 112$B_1$ while moving relatively to the recessed surfaces 112$A_1$ and 112$B_1$, and crimps the crimp terminal 1 onto the electric wire 50.

The terminal cut body 121 is arranged to be adjacent to the first die 112, and includes the opening edge 121*c*. The opening edge 121*c* is a second edge part corresponding to the upper surface edge 112*a*. While moving relatively to the first die 112 in the same direction as a moving direction of the second die 113, the terminal cut body 121 cuts off the boundary between the connecting part 32 and the crimp terminal 1 with the opening edge 121*c* in cooperation with the upper surface edge 112*a*.

The end of the recessed surfaces 112$A_1$ and 112$B_1$ on the upper surface edge 112*a* side of the first die 112 is inclined toward the second die 113 as coming closer to the upper surface edge 112*a*. The end of the recessed surfaces 112$A_1$ and 112$B_1$ on the upper surface edge 112*a* side is inclined, so that the bent part 18G is formed on the bottom face 18 of the crimp terminal 1 after crimping.

Accordingly, the terminal crimping apparatus 100 according to the embodiment can prevent interference between the terminal accommodating part and the electric wire connection part 12.

Modification of Embodiment

The following describes a modification of the embodiment. The shape of the recessed part 18C is not limited to the exemplified shape. For example, the shape of the first inclined surface 18D or the second inclined surface 18E on a vertical section is not limited to a straight line, and may be bent or curved. The shape of the recessed surface 112$B_1$ of the second anvil 112B is not limited to the exemplified shape. For example, the shape of the recessed surface 112$B_1$ on a vertical section is not limited to a straight line, and may be bent or curved.

On the bottom face 18, a range in which the recessed part 18C is formed along the first direction L is not limited to substantially the entire coating crimping part 12B. The range in which the recessed part 18C is formed is a predetermined range from the rear end 18R toward the front side. The predetermined range may be, for example, a range of substantially a half of the total length of the coating crimping part 12B, or a range of about ⅔ of the total length.

A range in which the inclined part 112*s* is arranged in the second anvil 112B is defined so as to cause the range in which the recessed part 18C is formed to be a predetermined range. The inclined part 112*s* may be, for example, in a range of substantially a half length on the rear end side of the second anvil 112B, or in a range of a length of about ⅔ on the rear end side of the second anvil 112B.

On the bottom face 18, a third surface may be interposed between the first inclined surface 18D and the second inclined surface 18E. The third surface may be, for example, a surface parallel with the virtual plane S2 when the crimp terminal 1 is viewed from the side. The third surface may be a surface inclined with respect to the virtual plane S2 when the crimp terminal 1 is viewed from the side. The recessed surface 112$B_1$ of the second anvil 112B may be configured to form the third surface on the bottom face 18. That is, a portion where the third surface is formed may be arranged on a side closer to the rear end than the inclined part 112*s* in the second anvil 112B.

In the electric wire connection part 12 after crimping, the rear end 18R of the bottom face 18 may project from the virtual plane S2 (refer to FIG. 27). Even if the rear end 18R projects toward the opposite side of the center axis C1 with respect to the virtual plane S2, a projecting amount of the rear end 18R is reduced due to formation of the bent part 18G. Accordingly, interference between the electric wire connection part 12 and the terminal accommodating part is prevented. In other words, if interference between the electric wire connection part 12 and the terminal accommodating part is prevented, the rear end 18R can be allowed to project from the virtual plane S2.

The electric wire connection part 12 crimped by the terminal crimping apparatus 100 according to the embodiment is not limited to an integral type. In the integral type electric wire connection part 12, the barrel piece parts 15 and 16 continue from the core wire crimping part 12A to the coating crimping part 12B. That is, in the integral type electric wire connection part 12, the core wire crimping part 12A, the coupling crimping part 12C, and the coating crimping part 12B are integrally wound around and crimped onto the electric wire 50. In place of the electric wire connection part 12 as described above, the terminal crimping apparatus 100 may crimp a separate type electric wire crimping part onto the electric wire 50. With the separate type electric wire connection part, the core wire crimping part and the coating crimping part are independently crimped onto a core wire and a coating, respectively. The second anvil 112B causes the coating crimping part in the separate type electric wire connection part to be crimped onto the coating.

In the connecting part 32, a portion that is to be cut off at the terminal cutting step is not limited to the boundary 32*b*. That is, the connecting part 32 may be cut off so that the cutoff 32*a* is slightly left in the crimp terminal 1 cut off from the terminal chain body 30. Thus, in the electric wire 2 with a terminal, the cutoff 32*a* may be left in the electric wire connection part 12.

Pieces of content disclosed in the embodiment and the modification described above may be appropriately combined to be executed.

The electric wire with a terminal according to the present embodiments includes an electric wire, and a crimp terminal including a terminal connection part on a front side and an electric wire connection part on a rear side, the terminal connection part being configured to be electrically connected to a counterpart terminal, the electric wire connection part being wound around and crimped onto the electric wire. A bent part is formed on a bottom face of the electric wire connection part, the bent part being bent toward a side for causing the rear end of the bottom face to be closer to the center axis of the electric wire connection part. In the electric wire with a terminal according to the present embodiments, the rear end of the bottom face hardly projects, so that interference between the crimp terminal and the terminal accommodating part can be prevented.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An electric wire with a terminal comprising:

an electric wire; and a crimp terminal including a terminal connection part on a front side and an electric wire connection part on a rear side, the terminal connection part being configured to be electrically connected to a counterpart terminal, the electric wire connection part being wound around and crimped onto the electric wire, wherein the electric wire connection part includes a bottom part, a first barrel piece part, and a second barrel piece part, the first barrel piece part and the second barrel piece part projecting from ends in a width direction of the bottom part, and a bent part is formed on a bottom face of the bottom part, the bent part being bent toward a side for causing a rear end of the bottom face to be closer to a center axis of the electric wire connection part.

2. The electric wire with a terminal according to claim 1, wherein a recessed part recessed toward the center axis is formed on a rear side compared to the bent part of the bottom face, a portion on a front side of the recessed part is an inclined surface that comes closer to the center axis toward a rear side, and a portion on a rear side of the recessed part is an inclined surface that is away from the center axis toward the rear side.

3. The electric wire with a terminal according to claim 1, wherein when the electric wire connection part is viewed from a side, the rear end of the bottom face is positioned on an extension line of a portion on a front side compared to the bent part of the bottom face, or positioned closer to the center axis than the extension line.

4. The electric wire with a terminal according to claim 2, wherein when the electric wire connection part is viewed from a side, the rear end of the bottom face is positioned on an extension line of a portion on a front side compared to the bent part of the bottom face, or positioned closer to the center axis than the extension line.

5. The electric wire with a terminal according to claim 1, wherein the electric wire connection part includes a core wire crimping part crimped onto a core wire of the electric wire and a coating crimping part crimped onto a coating of the electric wire, and the bent part is formed on a bottom face of the coating crimping part.

6. The electric wire with a terminal according to claim 2, wherein the electric wire connection part includes a core wire crimping part crimped onto a core wire of the electric wire and a coating crimping part crimped onto a coating of the electric wire, and the bent part is formed on a bottom face of the coating crimping part.

7. The electric wire with a terminal according to claim 3, wherein the electric wire connection part includes a core wire crimping part crimped onto a core wire of the electric wire and a coating crimping part crimped onto a coating of the electric wire, and the bent part is formed on a bottom face of the coating crimping part.

8. A terminal crimping apparatus comprising:

a terminal supply device configured to supply a terminal chain body including a plurality of crimp terminals arranged in parallel, a coupling piece extending along an arrangement direction of the crimp terminals, and a connecting part connecting one end of the crimp terminal with the coupling piece;

a first die including a supporting surface configured to support the crimp terminal supplied by the terminal supply device, and a first edge part arranged at one end of the supporting surface;

a second die arranged to be opposed to the supporting surface, and configured to sandwich the crimp terminal and the electric wire between the second die and the supporting surface to crimp the crimp terminal onto the electric wire while moving relatively to the supporting surface; and a terminal cut body arranged to be adjacent to the first die and including a second edge part corresponding to the first edge part, wherein the terminal cut body moves relatively to the first die in the same direction as a moving direction of the second die, and cuts off a boundary between the connecting part and the crimp terminal with the second edge part in cooperation with the first edge part, and an end of the supporting surface on the first edge part is inclined toward the second die as coming closer to the first edge part.

9. The electric wire with a terminal according to claim 1, wherein the bottom face is bent at the bent part in a projecting shape projecting toward the side away from the center axis.

* * * * *